United States Patent [19]

Kobayashi

[11] Patent Number: 4,522,409

[45] Date of Patent: Jun. 11, 1985

[54] TOY ARCADE GAME

[75] Inventor: Nobuo Kobayashi, Tokyo, Japan

[73] Assignee: Tomy Kogyo Company, Incorporated, Japan

[21] Appl. No.: 463,389

[22] Filed: Feb. 3, 1983

[30] Foreign Application Priority Data

Feb. 5, 1982 [JP] Japan ..... 57-17916

[51] Int. Cl.[3] ..... A63F 9/00

[52] U.S. Cl. ..... 273/316; 273/1 GC

[58] Field of Search ..... 273/1 GE, 313, 315, 273/316; 46/175 AR

[56] References Cited

U.S. PATENT DOCUMENTS

| | | | |
|---|---|---|---|
| 2,531,608 | 11/1950 | Bula | 273/316 |
| 3,397,484 | 8/1968 | Ryan et al. | 46/175 AR |
| 4,241,925 | 12/1980 | Watanabe | 273/316 |
| 4,326,721 | 4/1982 | Minami et al. | 273/315 |

FOREIGN PATENT DOCUMENTS

| | | | |
|---|---|---|---|
| 900104 | 7/1962 | United Kingdom | 273/316 |

*Primary Examiner*—Anton O. Oechsle

*Attorney, Agent, or Firm*—K. H. Boswell; Edward D. O'Brian

[57] ABSTRACT

A toy arcade game has a housing with a motor located therein. The motor is connected via various drive trains to move a target through a target field, a target coordination member, and an attack mechanism including an attack coordination member. The target coordination member moves between an interaction position when the target is in its hit position and a non-interaction position when it is not. Under the influence of an initiator member the attack coordination member moves from a non-interaction position to an interaction position and back again to the non-interaction position. An interaction member is mounted on the housing to move from a first position to a second position when both the target coordination member and the attack coordination member are simultaneously in their respective interaction positions. An indicating mechanism located in the housing is capable of producing a sensory perceivable output, inter alia, in response to location of said interaction member in its second position.

52 Claims, 21 Drawing Figures

FIG. 1.
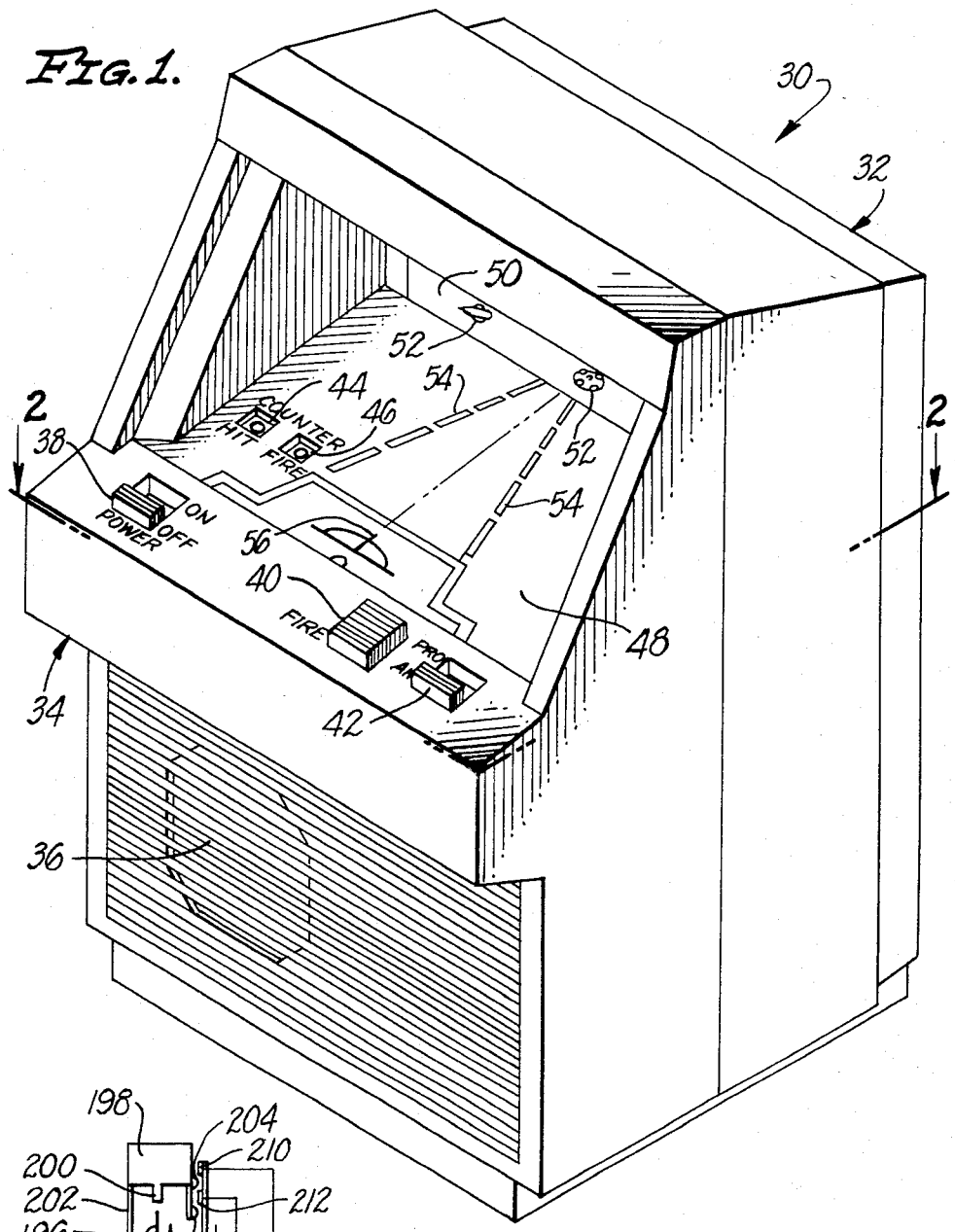
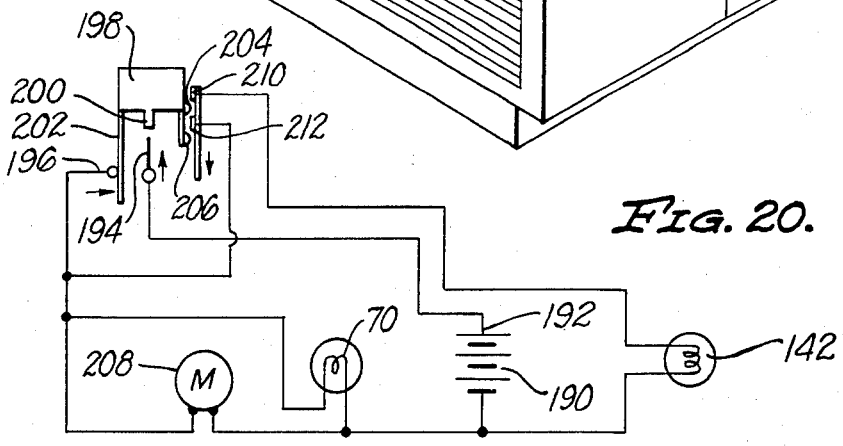
FIG. 20.

FIG. 9.
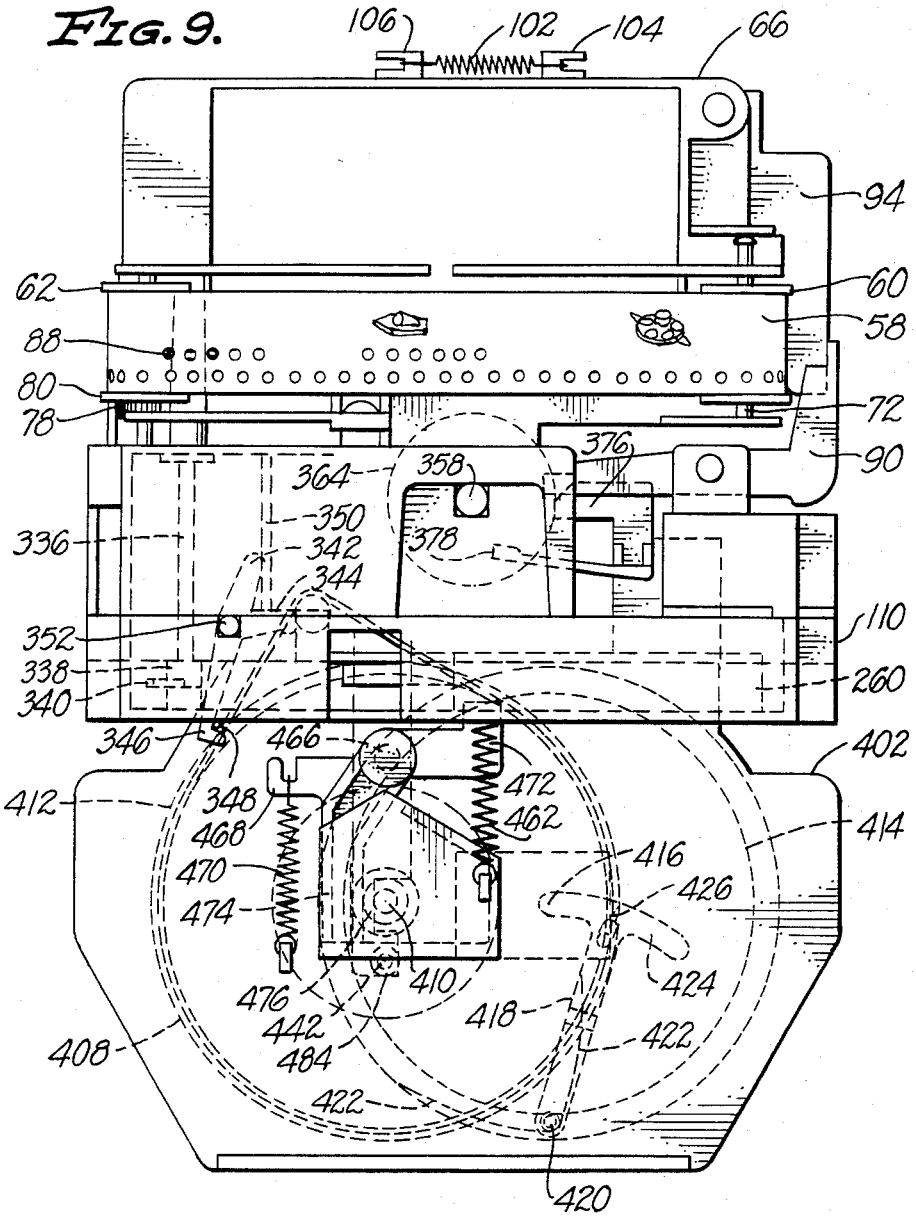
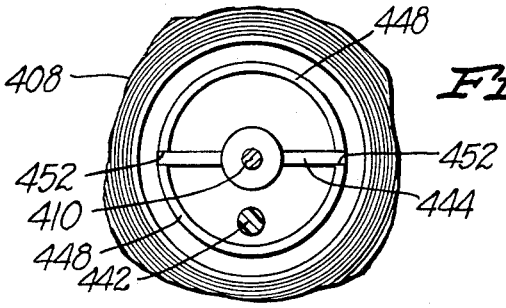
FIG. 10.

TOY ARCADE GAME

BACKGROUND OF THE INVENTION

This invention is directed to a toy game apparatus broadly incorporating a target and an attack mechanism.

One of the most popular and entertaining themes of an arcade type game is that wherein an attempt is made to systematically eliminate a target or plurality of targets by firing on the target or targets with an attack member, a missile, or the like. In older type arcade games, electromechanical components were utilized to achieve these results. These were generally fairly sophisticated, complicated mechanisms which were expensive to manufacture and thus were limited to an arcade type situation. Recently, with the advent of micro-electronics, the prior electromechanical arcade games have been replaced with solid state electronic games, utilizing cathode ray tubes as their output source.

The devices utilizing cathode ray tubes, as with the prior electromechanical devices, are also expensive. To circumvent this for individual use, certain hand-held devices have been developed which utilize liquid crystal technology for construction of an output source. These hand-held LCD devices are increasing in sophistication in quantum leaps. However, they, too, are relatively expensive to the consumer, and are mainly limited to a visual sensory perception mode in their operation. While beeps and tones can be incorporated into these devices, sophisticated auditory output has yet to be developed for these devices.

BRIEF DESCRIPTION OF THE INVENTION

In view of the above, it is an object of this invention to provide an arcade type game of such a size that it is capable of being held by hand, yet is based on mechanical components which can provide both visual and auditory sensory output. It is a further object of this invention to provide such a device which is capable of two levels of usage, such that it can be utilized by the novice, yet its complexity can be increased to challenge the dexterity and senses of the more sophisticated player. Further, it is an object of this invention to provide such a device, which, because of its engineering and design, is capable of mass production and thus economic availability to the consumer.

These and other objects, as will become evident from the remainder of this specification, are achieved in a toy which comprises: a housing; drive means located on said housing; target means mounted on said housing in operative association with said drive means, said target means including a target and a target coordination means, both said target and said target coordination means continuously moving through a target field wherein said target field includes a target hit position, said target coordination means moving between an interaction position and a non-interaction position with said target coordination means being in said target interaction position when said target is in said hit position; attack means movably mounted on said housing in association with said drive means, said attack means including an attack coordination means, said attack coordination means temporarily operatively connectable to said drive means and when so temporarily connected said drive means moving said attack coordination means; initiation means operatively associated with said attack means, said initiator means located on said housing in a position enabling said initiator means to be acted upon by an operator of said toy, said initiator means operatively interacting with said attack means to temporarily operatively connect said attack coordination means with said drive means whereby said drive means moves said attack coordination means from its non-interaction position to its interaction position and then back to its non-interaction position; interaction means movably mounted on said housing in operative association with said target coordination means and said attack coordination means, said interaction means movable on said housing between a first position and a second position, said interaction means movable from its said first position to its said second position when both said target coordination means and said attack coordination means are simultaneously in their respective interaction positions and said interaction means incapable of moving from its said first position to its said second position when either one or both of said target coordination means and said attack coordination means are in their respective non-interaction position; means associated with said interaction means for moving said interaction means from its said first position to its said second position; indicating means located on said housing, said indicating means capable for producing an output which is sensory perceivable by said operator of said toy, said indicating means producing said sensory perceivable output when said operator of said toy has acted upon said initiator means in association with said target being in said hit position resulting in both said target coordination means and said attack coordination means being in their interaction position thereby allowing said interaction means to move to its second position.

Preferred, a reset means is incorporated in the toy which, in response to the interaction means moving from its first position to its second position, repositions the interaction means from its second position back to its first position. A first switch means can be associated with the reset means and the drive means, with the first means capable of activating the reset means when the interaction means is in its second position, to move the interaction means from its second position back to its first position. A second switch means can be associated with the attack means, connecting the attack means to the drive means. The second switch means would include an initial switching position and a subsequent switching position with the drive means capable of driving the attack means when the second switch means was in the initial switching position. The interaction means would be capable of interacting with the second switch means to switch the second switch means from its initial position to its subsequent position in response to the interaction means moving from its first position to its second position with the interaction switching the second switch means from its subsequent position to its initial position in response to the interaction means moving from its second position to its first position.

Preferred, the attack means would include an attack indicator means operatively associated and moving in conjunction with the attack coordination means as the attack coordination means moves from its non-interaction position to its interaction position. Further, an interaction counting means would be capable of displaying a log reflecting movement of the interaction means from its first position to its second position and an initiator counting means which would be capable of displaying a log reflecting the acts of said operator on said initiator means.

The target means can include a plurality of targets, each movable through the target field and each independently positionable in the target hit position. When a plurality of targets are utilized, the target coordination means would be located in the interaction position whenever any of the individual targets is within the hit position within the field.

The attack coordination means preferredly includes an attack coordination member and the reset means preferred includes a reset member. The attack coordination member and the reset member can both be rotatably mounted about a common axis of rotation with each of these being axially displaced along this axis of rotation with respect to the other in a position locating each in association with the interaction means. Preferredly, the interaction means comprises an interaction member slidably mounted in the housing in association with both the attack coordination member and the reset member and movable with respect to each.

In the preferred embodiment, the target coordination means can include an inhibiting member positioned adjacent to the interaction member and movable with respect to the interaction member between an inhibiting position and a non-inhibiting position. The inhibiting member would be capable of preventing the interaction member from sliding on said housing between its first and second positions when the inhibiting member is in its inhibiting position and allowing said interaction member to slide on said housing from its first to its second position when the inhibiting member is in its non-inhibiting position.

In the preferred embodiment of the invention, the attack coordination member could include a plurality of attack coordination elements, each having a noninteracting position and an interacting position. The interaction member would be capable of interacting with each of the attack coordination elements with each individual attack coordination element when interacting with said interaction member allowing or preventing said interacting member from sliding on said housing from its first position to its second position. Likewise, the reset member can include a plurality of reset elements equal in number to the number of the plurality of attack coordination elements. Each of the reset elements would be capable of interacting with the interaction member to slidably move the interaction member on the housing from its second position to its first position.

The drive means can include a motor, a gear train means, an attack connecting gear, and a reset connecting gear. The gear train means would extend between the motor and both the attack connecting gear and the reset connecting gear. Said attack coordination member would be capable of operatively connecting to and being rotated by the attack connecting gear, with the reset member being capable of being connected to and rotated by the reset connecting gear. The second switch means would be in a position in the gear train means between the motor and the attack connecting gear. The initiator means would interact with the attack coordination means to incrementally rotate the attack coordination means to connect the same to the attack connecting gear. The interaction member, in moving from its second position to its first position, would contact the reset member to incrementally rotate the reset member to engage it with the reset connecting gear.

Preferredly, the target means would include an endless element mounted on the housing so as to be continuously moved on a pathway on the housing with said hit position comprising a hit location in the pathway. One or more targets would be located on the endless element. The target coordination means would include an endless element output means movable on said housing in response to movement of said endless element. The endless element output means would be associated with said inhibiting means to move said inhibiting means between its inhibiting and its noninhibiting position.

The attack means can include an attack indicator means which would include a first and second cylindrical element and a light emitting means. The second cylindrical element would be coaxially rotated around the first cylindrical element with the first cylindrical element including an axially extending light transmitting slot and the second cylindrical element including a helical extending light transmitting slot. A light emitting window would be formed at the point wherein the helical slot on the second cylindrical element overlayed the axial slot on the first cylindrical element with the light emitting window being movable along the length of the attack indicator means as the second cylindrical element rotates about the first cylindrical element, repositioning the window as the helical slot moved with respect to the axial slot.

Preferredly, the toy would include a sound reproducing means connected to the drive means and driven by the drive means with the sound reproducing means capable of emitting a recorded sound.

BRIEF DESCRIPTION OF THE DRAWINGS

This invention will be better understood when taken in conjunction with the drawings wherein:

FIG. 1 is an isometric view of a toy game incorporating the principles of this invention;

FIG. 9 is a rear elevational view of the components seen in FIG. 7 with underlying components shown in phantom line;

FIG. 10 is a fragmentary elevational view in partial section of a portion of the components located in the center of the bottom section of FIG. 9;

FIG. 20 is a schematic of the electrical circuit of the embodiment of FIG. 1.

Figure 2:
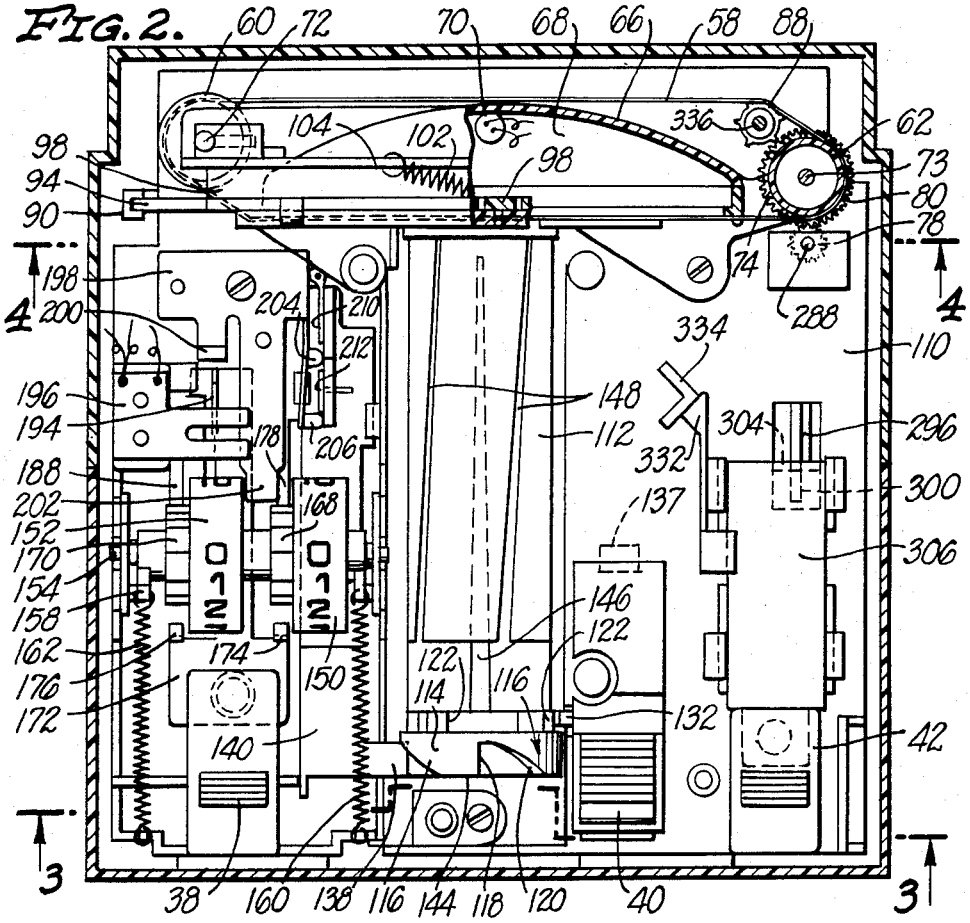
FIG. 2 is a top plan sectional view taken about the line 2—2 of FIG. 1 with certain overlying components broke away for clarity of underlying components.

The invention described in this specification and illustrated in the drawings utilizes certain principles and/or concepts as are set forth in the claims appended to this specification. Those skilled in the toy arts will realize that these principles and/or concepts are capable of being utilized in a variety of embodiments differing from the embodiment utilized for illustrative purposes herein. For this reason, this invention is to be construed in light of the claims, and is not to be construed as being limited to the illustrative embodiment.

DETAILED DESCRIPTION OF THE INVENTION

In reference to the drawings, in FIG. 1 there is shown a toy 30 designed as a miniature game capable of being held in ones hand or of being placed on a table or the like during utilization of the toy. The toy 30 has several component parts including a back housing 32 and a front housing 34 which are mated together during assembly. On the front housing 34 there is a speaker port 36 through which a sound is emitted as indicated below. There are several controls, including off/on button 38, fire button 40 and pro/am button 42. Two separate counting, or log, mechanisms, hit counter 44 and fire counter 46, are recessed inwardly from the off/on switch 38.

The two counters 44 and 46 are located on an essentially horizontal surface 48 which extends inwardly from the buttons 38, 40 and 42 and then joins an essentially vertical surface 50 recessed within the confines of the toy 30.

The game 30 is played as follows. The pro/am button 42 is pushed to one of two positions to reflect the skill level of the player. At the amateur position, i.e. the most forward position seen in FIG. 1, less skill is required to play the toy 30 than at the pro position, wherein the button 42 would be pushed inwardly toward the back of the toy 30, as seen in FIG. 1. After selecting the level of play using button 42, off/on button 38 is pushed from its off position to its on position. At this time, certain mechanisms within the toy 30, as hereinafter explained, are energized. Among these is a light, hereinafter identified, which is located behind the vertical surface 50 and which lights up target images, identified by the numeral 52, two of which are seen in FIG. 1. The target images 52 are seen to move horizontally across the vertical surface 50 upon energizing of the game with the off/on button 38. At start of play, when the off/on button 38 is turned to the on position, the counter, or log, mechanisms 44 and 46, have automatically been reset to zero, as is seen in FIG. 1.

Certain indicia on the horizontal surface 48 move toward a vanishing point located on the pathway of the target images 52. This indicia is identified by the numeral 54 and leads to a target hit position directly in its center, wherein the horizontal surface 48 meets the vertical surface 50.

As one of the target images 52 approach this hit position, the fire button 40 is depressed. When this happens, an attack missile, not separately numbered or shown, moves from position 56 toward the hit position, attacking one of the target images 52. The attack missile is formed by a light image which can be seen in the horizontal surface 48. This light image moves from the start position 56 toward the hit position, "attacking" the particular target image 52 which is approaching the hit position. Concurrent with the movement of this attack missile, an audible sound is emitted via the speaker port 36 indicating that fire button 40 has been depressed.

If the attack missile arrives at the hit position concurrently with the arrival of the target image 52, movement of the target images 52 across the vertical surface 50 ceases, and a visual image depicting an explosion is seen on vertical surface 50 upwardly from the target images 52 (in a position not viewable in FIG. 1.). Concurrently, a further audio signal is emitted via the speaker port 36 indicating that the target image 52 was successfully "hit" by the attack missile. After the lapse of a predetermined period of time, the visual images seen on the vertical surface 50 is extinguished concurrently with the extinguishment of the audio output via the speaker port 36 and the target images 52 continue to move across the vertical surface 50.

Upon depression of the fire button 40, a tally or log of this is indicated on the fire counter 46. Each time the fire button 40 is depressed, the next highest numerical indicia is shown on the fire counter 46. Upon each successful "hit" of the attack image on one of the targets 52 which results in the visual and audio sensory perceivable output of a successful "hit" of the target image 52 by the attack image, the "hit" is counted on the hit counter 44 by recording of a numerical indicia on it.

As hereinafter evident, the toy 30 is designed to allow the operator of the toy 30 a finite number of turns to fire the fire button 40. Normally, this is set up at the number ten. With ten turns on the fire button 40, theoretically it would be possible to accumulate ten "hits" on the hit counter 44. It is therefore an object of the game to score as many successful "hits" as possible with the limited number of "firing attempts" as are incorporated into the toy 30. If the arrival of the attack image on the target image 52 is not coordinated with the position of the target image 52 at its hit position, of course a "miss" will have occurred, and while the fire counter 46 will tally the "shot" taken, no "hit" will be tallied on the hit counter 44.

When the number of "shots" which have been incorporated into the mechanism of the game have been tallied on the fire counter 46, the game 30 automatically shuts itself off, stopping movement of the target images 52 across the vertical surface 50 as well as extinguishing the lighting means which light up these target images. To reset the game, the operator of the toy 30 must then return the off/on switch 38 from the on position to the off position, which automatically resets both the hit counter 44 and the fire counter 46 to zero.

When the pro/am button 42 is in the ameteur or lower skill position, the target images 52 move across the vertical surface 50 at a constant rate of speed. This renders it easier to judge when to depress the fire button 40 in order to score a "hit" on a particular target image 52. When the pro/am button 42 is pushed to the pro position, or higher skill level, the speed of the target images 52 across the vertical surface 50 is variable, as hereinafter explained, making it more difficult to judge when to coordinate depressing of the fire button 40 in order to score a "hit" on one of the target images 52. During the higher skill level play, the target images 52 are capable of moving across the vertical surface 50 at two speeds. Movement of the target images 52 at the faster of the two speeds of course will require depressing of the fire button 40 earlier than when these images move at the slower speed. Additionally, after the fire button 40 is depressed, the target images 52 could shift from the slow speed to the fast speed, or vice versa, thus causing the target image 52 to slow down or speed up, disrupting the arrival of the same at the hit position, to complicate the play of the toy 30.

In further discussing the toy 30, the operation of certain of the systems of the toy 30 will be discussed, noting that motion is communicated to these systems with the actual elements which propagate the motion to these systems discussed in detail after several of the systems are discussed. Further, with regard to many of the components of the toy 30, they are rotatably mounted within the toy 30 on appropriate bearing surfaces and the like, and in the interest of bervity of this specification and simplicity in numbering the drawings, the individual bearing surfaces, bosses and the like will not be separately identified or numbered, it being sufficient to state at this time that all appropriate gears, axles and the like are sufficiently suspended within the toy 30, allowing them to rotate as indicated.

Figure 4:
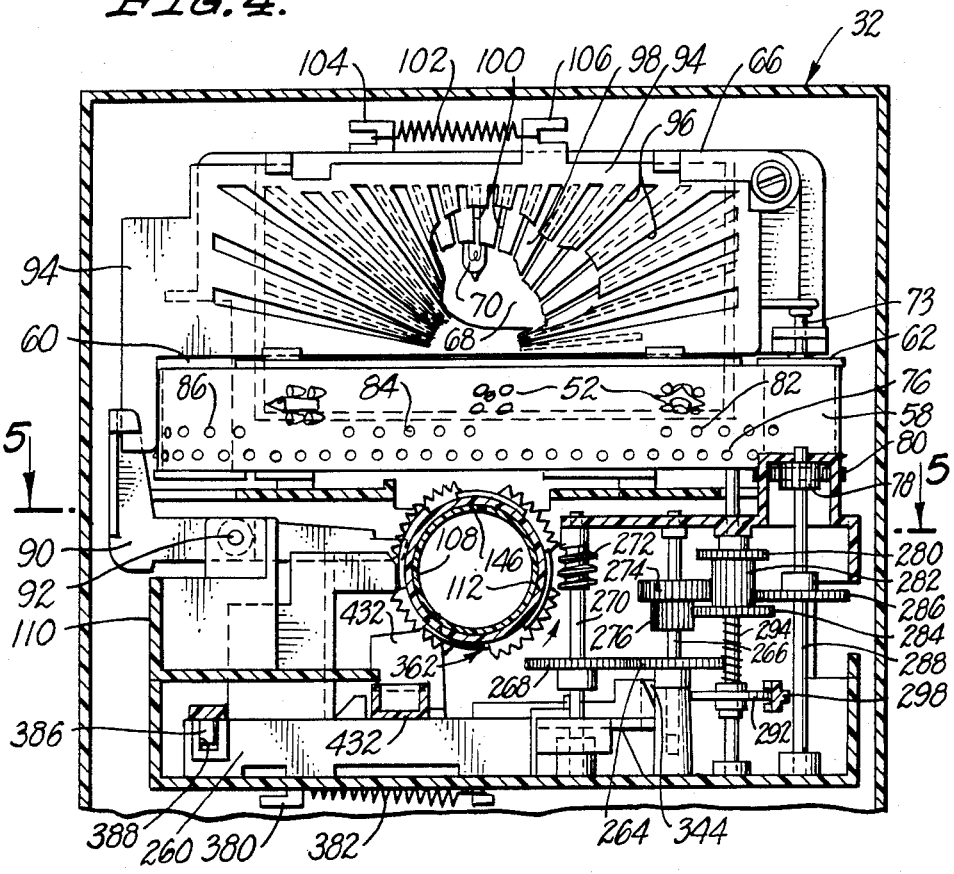
FIG. 4 is an elevational sectional view about the line 4—4 of FIG. 2 with certain components broken away.

Referring now to FIGS. 2 and 4, the component system from which the target images 52 originate will be discussed. An endless belt 58 is located to rotate around spools 60 and 62. The belt 58 is positioned in the toy 30 directly behind the vertical surface 50 wherein it mates with the horizontal surface 48. The endless belt 58 is black in color such that it cannot be seen behind the vertical surface 50. It carries on it several colored indicia, such as the indicia 64 shown in FIG. 4.

An internal upper housing 66 has a hollow area 68 located in it. A light bulb 70 is located in this hollow area. As hereinafter explained, during operation of the toy 30 the light bulb 70 is energized and emits light. The top half of the endless belt 58 is located over the bottommost portion of the hollow area 68 and as such light from the light bulb 70 can shine through the top portion of the endless belt 58. It is this portion wherein indicia 64 are located. The light bulb 70 shines through the indicia 64 and their images are shown on vertical surface 50 as the target images 52. As the endless belt 58 moves about spools 60 and 62 as hereinafter explained, the indicia 64 move from right to left as seen in FIG. 4, moving them in a pathway across the vertical surface 50, which includes the hit position previously discussed which is located in about the center of FIG. 4.

The spool 60 is freewheeling about an axle 72 which is appropriately mounted in the internal upper housing 66. The spool 62 is also freewheeling, about an axle 73 which is appropriately mounted in the internal upper housing 66. The spool 62 has a plurality of teeth 74 near its lower edge which fit into a plurality of holes 76 evenly spaced near the lower periphery of the endless belt 58. The teeth 74 engage the holes 76 and drive the endless belt 58 about the spool 62, which in turn drives it about the spool 60. The spool 62 is, in turn, driven by a pinion 78 which is rotated, as hereinafter described, continuously during the operation of the toy 30 with the pinion 78 meshing with a spur gear 80 formed on the bottom of the spool 62.

Positioned above the holes 76 in the endless belt 78 are some other holes. These are grouped in sets, such as the sets 82, 84 and 86 seen in FIG. 4. Each of the indicia 64 is associated with one of the sets of holes, sets 82, 84, 86, or other sets not seen in FIG. 4 which lie on the back side of the endless belt 58. However, the particular set of holes in which a particular indicia is associated is not that set of holes lying directly beneath it, but is a set of holes which is shifted along the belt 58 such that, as viewed in FIG. 2, when a particular indicia 64 is located in the direct center of FIG. 2, the set of holes with which that indicia is associated would be located adjacent to gear 88, which serves as an endless belt output gear. The output gear 88 is flat on one side and contains five gear teeth on the other side. As the endless belt 58 moves around the spool 62 in those areas of the endless belt 58 wherein a set of holes, such as the holes 82, 84 and 86, are not located, the endless belt 58 slides along the portion of the gear 88 which does not have any teeth. When one of the sets of holes, such as sets 82,84 or 86, is located over the endless belt output gear 88 the teeth on the output gear 88 engage these holes, and as the endless belt 58 moves, the endless belt output gear 88 is rotated as the particular holes of the particular set move past the gear 88. It is at this time, when the gear 88 is being rotated, that the particular indicia 64 which is associated with that particular set of holes is approaching and is located in the hit position which would be in the center of FIGS. 2 and 4, as previously indicated. When the particular indicia 64 has moved past or beyond this hit position, the particular set of holes has moved past and beyond the gear 88 and the flat or toothless portion of the gear 88 is now once again located against the inside surface of the endless belt 58. Once again now the endless belt 58 slides on the surface of the gear 88, not rotating the same. When the next set of holes, sets 82, 84, 86, or another set of unlabelled holes, approaches the gear 88 the next indicia 64 is approaching the hit position. The gear 88 thus serves as an output element with respect to the hit position, with the indicia 64 lighted by the light bulb 70 to create the target images 52 serving as the visual indicator to the operator of the toy 30 of when a particular set of holes, be they holes 82, 84, 86, or some other set, are positioned and engaged with the gear 88.

Lying directly above the endless belt 58 is the visual indicating means for indicating when the attack image successfully "hits" the target image 52. By a mechanism hereinafter explained, a lever 90 seen on the left hand side of FIG. 4 is rotated clockwise in FIG. 4 about its axle 92 when such a "hit" occurs. The lever 90 contacts a plate 94. The plate 94 has a series of radiant openings, collectively identified by the numeral 96, in its surface. The plate 94 is located over a second back plate 98. The back plate 98 also includes a set of radiant openings, collectively identified by the numeral 100. As is evident from viewing FIG. 4, both sets of radiant openings 96 and 100 converge to a center point. The radiant openings 96, however, are rotated a few degrees clockwise with respect to the radiant openings 100 such that if the center of radiation of the openings 96 and 100 are positioned one over the other, the totality of the radiant openings 96 and 100 do not overlay each other.

The plate 94 is slid from left to right as seen in FIG. 4, when the lever 90 is rotated clockwise. A small spring 102 connects from a tab 104 on plate 98 to a tab 106 on plate 96. As the plate 94 is slid from left to right over the surface of the plate 98 this stretches and tenses the spring 102. As the plate 94 slides over the plate 98, the areas of overlap between the radiant openings 100 and the radiant openings 96 slowly move outwardly along the radius of these radiant openings. Then a second area of overlap is created, and a third, etc., etc., to produce a sunburst type effect between the radiant openings 96 and 100.

The plate 98 overlays the majority of the hollow area 68 of the upper internal housing 66. This upper area is also illuminated by the light bulb 70. As the plate 94 moves across the plate 98 light is emitted in those areas of overlap in the radiant openings 96 and 100. As noted above, these areas changes as the plate 94 slides on the plate 98 and thus the light emitted from the areas of overlap also changes in a sunburst-like pattern.

The light emitted from the areas of overlap between radiant openings 96 and 100 is seen through the vertical surface 50 as a visual indication that a "hit" has taken place between the attack image and the target image 52. After this "hit" has been indicated as hereinafter explained, the lever 90 is allowed to rotate counterclockwise, allowing the tension introduced in the spring 102 to shift the plate 94 from right to left in FIG. 4 to its original starting position on the plate 98. When the plate 94 is all the way to the left with respect to the back plate 98 there is no overlap between any of the radiant openings 96 and 100 and as such no light from the light bulb 70 is allowed to be emitted through these openings, and as such, during this time the portion of the vertical surface 50 positioned over these areas is totally dark.

Figure 14:
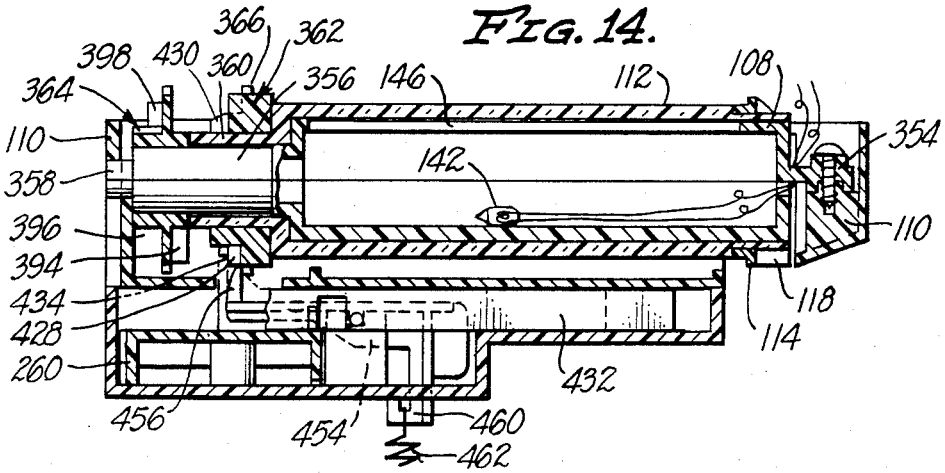
FIG. 14 is a side elevational view in section of certain of the components positioned in the center of FIG. 3.

The attack system, which is generally located in the centers of FIGS. 2, 3, 4 and 5, and whose elements are seen in section in FIG. 14, include a first cylindrical member 108 which is fixedly located in what one could consider as the internal middle housing 110. The first cylindrical member 108 has a second cylindrical member 112 rotatably mounted about it such that it is free to turn about the member 108. With each depression of the fire button 40, the member 112 is incrementally rotated under the initiation of the fire button 40. Further rotation is accomplished via other mechanisms described below such that upon each depression of the fire button 40, ultimately the second cylindrical member 112 rotates through 90 degrees of rotation.

The initial rotation of second cylindrical member 112 is as follows. As seen in FIG. 2, on the end of the cylindrical member 112 located toward the operator of the toy 30 there is a circular collar 114. The collar 114 is fixed to the second cylindrical member 112. The collar 114 includes four identical projections 116 symmetrically located around it, each of which includes a straight shoulder 118 and a wedge shoulder 120. Further, the collar 114 includes four identical engagement steps 122. The projections 116 are associated with the fire counter, as hereinafter explained, and the engagement steps 122 are associated with the fire button 40 as follows.

The fire button 40 is located in the toy 30 such that it moves vertically up and down. The bottom of the fire button 40 rests on a first class lever 124 pivotally mounted to the internal middle housing 110. The other end of the first class lever 124 includes a small axle 126 which engages underneath the bottom of a third class lever 128. Third class lever 128 is pivoted about its axle 130 and carries on its end opposite its pivot end a small bell crank 132. The bell crank 132 is pivoted to the lever 128 via an axle 134 with a spring 136 engaging one arm of the bell crank 132 tending to bias the bell crank 132 counterclockwise with the other arm of the bell crank 132 engaging the collar 114 in a position such that it can interact with the engagement steps 122.

Figure 3:
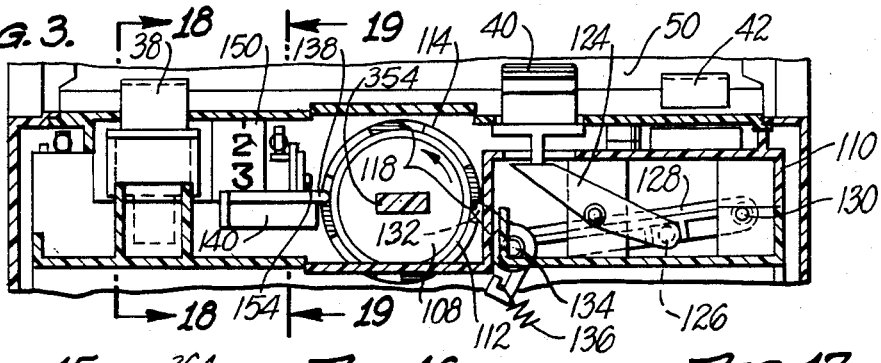
FIG. 3 is an elevational sectional view about the line 3—3 of FIG. 2.

The fire button 40 is pivoted to the internal middle housing 110 via tab 137 on its end which fits into an appropriate slot, not separatly identified or numbered, formed in the top of the internal middle housing 110. Upon depression of the exposed, or other end, of the fire button 40, the lever 124 is rotated, which in turn rotates the lever 128 causing the bell crank 132 to be raised upwardly such that it engages one of the engagement steps 122 to incrementally rotate the second cylindrical member 112 counterclockwise as seen in FIG. 3. Once rotation of the second cylindrical member 112 is started as hereinafter explained, rotation is continued through the above noted 90 degrees. After release of the fire button 40, the spring 136 draws the bell crank 132 downwardly, which in turn rotates the lever 128 in the opposite direction, allowing lever 124 to rotate in its opposite direction, lifting the fire button 40 upwardly, ready for the next activation of the same. The upper arm of the bell crank 132 rides against the collar 114 as it is rotated under the influence of rotation of the second cylindrical member 112 until the member 112 has rotated through 90 degrees. At such time the upper arm of the bell crank 132 is now engaged in the next engagement step 122 on the collar 114.

Figure 19:
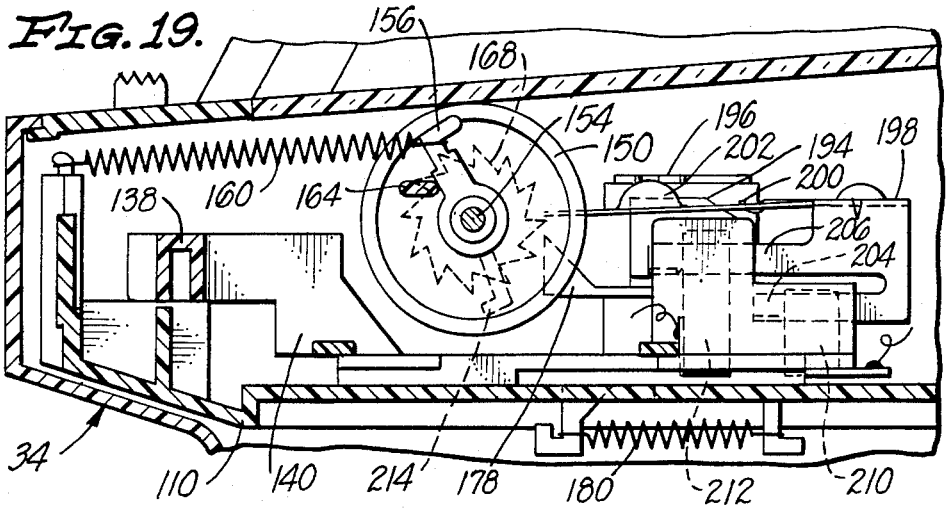
FIG. 19 is a side elevational sectional view taken about the line 19—19 of FIG. 3.

In reference now to FIGS. 2, 3 and 19, an arm 138 on fire slide member 140 is positioned to interact with the projections 116 on the collar 114. As collar 114 is incrementally initially rotated by the fire button 40 counterclockwise as seen in FIG. 3, the wedge shoulder 120 engages the arm 138 sliding the arm 138 and the fire slide 140 attached thereto forward, toward the observer in FIG. 3, and downward as seen in FIG. 2. The sliding of the fire slide member 140 downwardly in FIG. 2 does two things. One of these is to change the indicia exposed through the fire counter 46 and the second is to complete an electrical circuit as hereinafter explained, which lights light bulb 142, which is positioned in the interior of first cylindrical member 108. The fire slide member 140 is maintained in a position displaced downwardly from that seen in FIG. 2 by the interaction of the arm 138 on the shoulder 120 and across the front edge 144 of the projections 116 until such time that the second cylindrical member 112 has rotated 90 degrees, at which time the arm 138 then is positioned along straight shoulder 118, and as straight shoulder 118 is rotated below the arm 138, the arm 138 is no longer held against the projection 116 and under the bias of a spring as hereinafter identified, the fire slide member 140 slides upwardly as seen in FIG. 2 to the position shown in FIG. 2, once again engaging the arm 138 as seen in FIG. 2 with respect to the collar 114 in a position such that it can interact with the next wedge shoulder 128 located 90 degrees on the collar 114 from the one with which it has just interacted.

The two cylindrical members 108 and 112 are in part located beneath the horizontal surface 48. The portion of these cylindrical members 108 and 112 which are located beneath the horizontal surface 48 are opaque to light emitted by the light bulb 142 except for an elongated slot 146 formed in first cylindrical member 108 and four identical helical slots collectively identified by the numeral 148, formed in the second cylindrical member 112. Normally, between individual firings of the firing button 40, the second cylindrical member 112 is located with respect to the first cylindrical member 108 as is seen in FIG. 2. During this time, the helical slots 148 are displaced circumferentially with respect to the elongated slot 146 such that there is no window between the slots 146 and 148 allowing for escape of any light from the interior of member 108 upwardly from the light bulb 142 located in the interior of first cylindrical member 108. During rotation of the second cylindrical member 112 on the first cylindrical member 108 however, a "window" is formed between one of the slots 148 on the second cylindrical member 112 and the slot 146 on the first cylindrical member 108.

Since the slots 148 are helical (however, but of a helix of such a size that only a partial rotation of the same is completed on the member 112) as the member 112 rotates with respect to the member 108, a window will be formed in those areas of overlap between one of the slots 148 and the slot 146 with this "window" moving upwardly from bottom to top in FIG. 2 as the member 112 rotates counterclockwise as seen in FIG. 3 on the member 108.

During rotation of the member 112 on the member 108 as hereinafter explained, the light bulb 142 is activated, emitting light. As this happens, with rotation of the member 112 on the member 108, an attack image is produced as the "window" between one of the slots 148 and slot 146 progresses away from the collar 114. This "window" produces the attack image which moves from a position which is adjacent to the operator of the toy 30 toward the hit position on the toy 30 upon activation of the fire button 40. Additionally, both the slot 146 and the slots 148 taper away from the collar 114 such that as the attack image moves away from the operator of the toy towards the hit position, the window from which light from the bulb 40 is emitted slowly narrows, giving the impression that the attack image is moving away from the operator of the toy 30 toward a distant hit position wherein the target images 52 are located.

Figure 18:
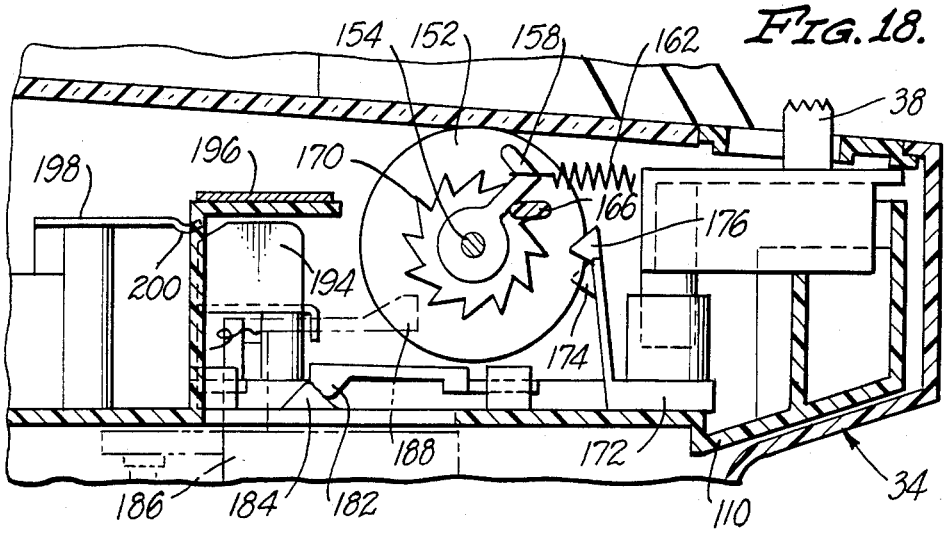
FIG. 18 is a side elevational sectional view taken about the line 18—18 of FIG. 3.

Referring now to FIGS. 2, 3, 5, 8 and 19, the hit and fire counters or log systems will be described. The fire counter drum 150 and the hit counter drum 152 are commonnly rotatably mounted on the internal middle housing 110 about an axle 154. On the side of the drum 150 opposite drum 152 is a lever arm 156 formed as a part of the drum 150. On the side of the drum 152 away from the drum 150 is similar lever arm 158 formed as a part of the drum 152. A spring 160 connects to the arm 156 and to the internal middle housing 110. Likewise, a spring 162 connects to the arm 158 and the internal middle housing 110. This biases the drum 150 counterclockwise as seen in FIG. 19 and the drum 152 clockwise as seen in FIG. 18. However, as FIGS. 18 and 19 are viewed at opposite directions, both of the drums 150 and 152 are biased in the same direction such that the zero numerals viewable on both in FIG. 2 would tend to be rotated back toward the observer in FIG. 2.

A stop 164 limits the amount of clockwise rotation of the arm 156 in FIG. 19 such that when the arm 156 abuts against the stop 164 the zero numeral is exposed in the fire counter 46. Likewise, a stop 166 limits the travel of the arm 158 such that when the arm 158 is abutted against the stop 166 the zero on the hit counter 44 is exposed. As both the drums 150 and 152 are rotated such that their respective arms 156 and 158 move away from the respective stops 164 and 166, the respective springs 160 and 162 are stretched, inducing tension therein, such that, upon release of the pressure, the force which is rotating the drums 150 and 152 and/or holding them in position is removed, the drums 150 and 152 will tend to rotate back to the positions wherein the zero neumeral on each of these is respectively exposed to view through the hit counter 44 and the fire counter 46.

The drum 150 carries a ratchet gear 168 integrally formed as a part of it on its side opposite the side wherein the arm 156 is located. The drum 152 carries a ratchet gear 170 interposed between the drum 152 and its arm 158.

An off/on slide member 172 is connected to the off/on button 38 and moves in conjunction with movement of the off/on button 38. The off/on slide member 172 carries two spring arms 174 and 176, respectively, which project upwardly such that they are capable of engaging the ratchet gears 168 and 170 under the following circumstances. When the off/on button 38 is in the off position, the spring arms 174 and 176 are withdrawn away from the ratchet gears 168 and 170 as can be seen in FIG. 18. When the off/on button 38 is pushed to the on position, this slides the off/on slide member 172 forward, such that the spring arms 174 and 176 engage against the respective ratchet gears 168 and 170. If the drums 150 or 152 are rotated as hereinafter explained, when they are rotated, the spring arms 174 and 176, respectively, hold the respective drums 150 and 152 in any new position they are rotated to as long as the off/on switch 38 remains in the on position, keeping the off/on slide member 172 pushed forward with the spring arms 174 and 176 engaged against the ratchet gears 168 and 170. When the off/on switch 38 is moved to the off position, this slides the off/on slide member 172 such that the spring arms 174 and 176 are withdrawn from their engagement with the ratchet gears 168 and 170, allowing the drums 150 and 152 to be rotated by any tension introduced into springs 160 and 162 connected thereto via the arms 156 and 158 as explained above.

The fire slide member 140 includes an engagement arm 178 located on it, which is positioned such that it can engage the ratchet gear 168 on the drum 150. As the fire slide member 140 is slid downwardly as seen in FIG. 2 by engagement of the projections 116 against the arm 138 on the fire slide member 140, the engagement arm 178 is brought to bear against one of the individual teeth of the ratchet gear 168. As viewed in FIG. 19, with each movement of the fire slide member 140 from right to left, the engagement arm 178 engages the ratchet gear 168 moving the ratchet gear through an increment of rotation corresponding to movement of one of the numerals exposed through the fire counter 46 to the next highest numeral exposed. The drum 150 is retained in this new position by the spring arm 174 as described above.

During movement of the fire slide member 140 from right to left as seen in FIG. 19, a spring 180 attached to the fire slide member 140 and to the middle housing 110 is tensed. Upon release of the arm 138 by the shoulder 118 the tension introduced into the spring 180 then returns the fire slide member 140 from left to right, which in turn disengages the engagement arm 178 from the ratchet gear 168 on the drum 150. The ultimate result, however, of movement of the fire slide member 140 from right to left and then back from left to right in FIG. 19 is the advancement of the numerical indicia exposed from the fire counter 46 from one number to its next highest number.

While the fire slide member 140 is free to slide backward and forward on the internal middle housing 110, the off/on slide member 172 is fixedly held either in a position corresponding to the off position of the off/on button 38 or in a position corresponding to the on position of the off/on button 38 via two spring arms collectively identified by the numeral 182, the ends of which move up over two wedges collectively identified by the numeral 184 formed on the surface of the internal middle housing 110. Each time the off/on button 38 and the off/on slide member 172 move from the off to the on position, or vice versa, the ends of the springs arms 182 must cross over the top of the wedges 184 to position these ends on one side or the other of the wedges 184 to maintain the off/on slide member 172 in either the off or the on position.

A hit slide member 186 which is moved as hereinafter explained during the scoring of a "hit", includes a spring arm 188 which projects upwardly and is located in association with the hit counter drum 152. The hit slide member 186 can be seen exploded in FIG. 13 and the spring arm 188 as well as portions of the slide member 186 are viewable in FIG. 18. Every time a "hit" is scored, the hit slide member 186 is moved from left to right as viewed in FIG. 18, such that the end of the spring arm 188 engages the ratchet gear 170 on the drum 152. With each engagement of the spring arm 188 with the ratchet gear 170 on the drum 152, the drum 152 is rotated counterclockwise as seen in FIG. 18, to advance the numerical indicia which is located on the surface of hit counter drum 152 and is exposed out of the hit counter 44 from one numeral to the next highest numeral.

In describing the electrical circuit of the toy 30, for brevity and easy identification, the same numeral will be utilized to identify the actual physical component which is shown in the structural figures as will be utilized to identify its schematic counterpart seen in the electrical circuit diagram of FIG. 20. For instance, light bulb 70 and 142 previously identified are identified in FIG. 20 by those numerals.

Batteries 190 are located in the toy 30 and accessible through a door, not numbered or seen, located in the back housing 32 of the toy 30. The positive side 192 of batteries 190 is connected to an electrical contact 194 which is affixed to the off/on slide member 172. Electrical contact 184 slides back and forth in association with the sliding movement of slide member 174 physically beneath an electrical contact 196, but at no time does the contact 194 make a circuit connection to the contact 196. When in the on position, the electrical contact 194 contacts an electrical contact member 198 which has several arms extending from it in different positions. Arm 200 is the arm which is engaged by the off/on electrical contact 194. Arm 202 extends under electrical contact 196 and terminates in a location positioned between the fire counter drum 150 and the hit counter drum 152. The arm 202 is movable up and down and is biased by its own internal "springiness" to be engaged upwardly against the bottom surface of the electrical contact 198 unless otherwise displaced. The remaining arms on the electrical contact 198 are arms 204 and 206.

Upon forming a circuit between electrical contact 194 and electrical contact 198 by the interaction of contact 194 with the arm 200 on the contact 198 the circuit is further propagated via arm 202 to contact 196. From there, lead wires connect to light bulb 70 and motor 208. These are both then grounded to the batteries 190.

The light bulb 142 is wired between the ground terminals of the batteries 190 and an electrical contact 210 which is mounted on the fire slide member 140. A further electrical contact 212 is also mounted on the fire slide member 140 and is shunted around the contact made via electrical contact 196 and spring arm 202. When the fire slide member 140 is moved in response to interaction of the collar 114 on the second cylindrical member 112 engaging the arm 138 on the fire slide member 140, the electrical contacts 210 and 212 contact the arms 204 and 206 on the electrical contact member 198. With the off/on contact 194 engaged against arm 200 of the electrical contact 198, movement of the fire slide member 140 and the contacts 210 and 212 located thereon complete a circuit through the light bulb 142 energizing the same, as long as contact 210 remains in contact with the arm 204 on the contact 198. Further at this time, the shunt circuit via contact 212 engaging the arm 206 is also energized. When the fire slide member 140 is released by the collar 114 and is returned from left to right as viewed in FIG. 19 under the tension introduced into the spring 180, the contact between contacts 210 and 212 engaging arms 204 and 206 is broken, which breaks the shunt circuit, as well as de-energizing the light bulb 142.

The shunt circuit between the contact 212 and the arm 206 is only utilized to maintain the motor 208 and the light bulbs 70 and 142 energized when the operator of the toy 30 is utilizing his last available "shot" of the fire button 140 with the fire counter drum 150 being rotated through the maximum number of steps possible so the last numerical indicia which is located on its surface has been exposed through the fire counter 46. At this time, as viewed in FIG. 19, the drum 150 has been rotated through many steps available on its ratchet gear 168 in a clockwise direction such that an arm 214, which is integrally formed with the drum 150 and is positioned between the drums 150 and 152 adjacent to the ratchet gear 168 is rotated from its position seen in FIG. 19, through approximately 270°, such that it can contact the end of the arm 202, depressing the arm 202 downwardly, breaking the electrical contact between the electrical contact member 198 on which the arm 202 is formed, and the electrical contact 196. As is evident from viewing the circuit diagram of FIG. 20, in the absence of the shunt circuit between the arm 206 and the contact 212, this would disrupt the circuit between the motor 208 and the light bulb 70. As long as the slide member 140 is engaged via the collar 114 on the second cylindrical member 112, the shunt circuit is in operation. Upon return of the fire slide member 140 from left to right as viewed in FIG. 19, the electrical contact 212 moves out of engagement with the arm 206, breaking the shunt circuit and since the circuit between the electrical contact 196 and 198 has been broken by the downward movement of the arm 202 by the arm 214, the circuit to the motor 208 and the light bulb 70 is then broken, shutting off the motor 208, stopping play of the toy 30. As noted in discussing the operation of the game above, at this time, all of the shots available to the operator of the toy 30 have been taken, as is evident by the exposure of the maximum numeral on the fire counter 46 and the operator of the game must then reset the game by turning the off/on button 38 to the off position, which releases the spring arms 174 and 176 from the drums 150 and 152, allowing them to rotate. Upon counterclockwise rotation of the drum 150 as viewed in FIG. 19, the arm 214 is rotated counterclockwise, releasing from the arm 202 formed on the electrical contact 198, re-establishing a potential circuit between the electrical contact 196 and 198 for the next sequence of play of the game 30 when the off/on button 38 is again pushed to the on position.

The mechanical drive train of the toy 30 as well as the play level associated with the pro/am button 42, will be discussed in reference to FIGS. 4 through 7, and 11 and 12. The motor 208 has an output pinion 216 which engages a spur gear 218. The spur gear 218 is integrally formed with a pinion 220 with the pinion 220 engaging a spur gear 222. Motion from the spur gear 222 is branched off to the audio sensory systems discussed below, as well as to an axle 224 which carries a pinion 226 on its end.

The pinion 226 engages a crown gear 228 which is fixedly mounted to an axle 230 such that the axle 230 rotates in response to rotation of the crown gear 228. Integrally formed on the bottom of, and rotating with, crown gear 228 is a pinion 232.

A downwardly projecting crown gear 234 is also fixed to the axle 230 and as such, rotates in conjunction with the rotation of the axle 230 imparted thereto by the rotation of the crown gear 228 which is ultimately rotated by the output pinion 216 of the motor 208.

A disk 236 is carried by the axle 230 but it does not rotate in conjunction with rotation of axle 230. The disk 236 has a small axle 238 formed on its upper surface, on which a pinion 240 is mounted. The pinion 240 meshes with the pinion 232 and is rotated by the pinion 232. A small spring 242 positioned around the axle 230 between the bottom crown gear 234 and the disk 236 biases the disk 236 upwardly to maintain the positioning of the pinion 240 in engagement with the pinion 232. The spring 42 also forms a very slight frictional engagement between the disk 236 and the crown gear 234 such that as the crown gear 234 rotates in response to rotation of the axle 232, the disk 236 also rotates unless it is held fast by other components as hereinafter explained.

A first pinion 244 lies underneath crown gear 234 and is rotated by crown gear 234. The pinion 244 is fixed to an axle 246 which carries a pinion 248 on its other end, also fixed to it, such that pinion 248 rotates in response to rotation of pinion 244. The pinion 248 engages a crown gear 250 which is fixed to an axle 252. The axle 252 further includes a reset connecting worm 254 on its upper end, which is also fixed to the axle 252 and rotates in response to rotation of the crown gear 250.

The disk 236, as noted above, rotates about axle 230. It includes two stops, stops 256 and 258, on its underside surface, which serve to position the pinion 240 in either an initial or a subsequent position, such that the position of the pinion 240 serves as a switch for communication of rotation propagated by the pinion 240. An interaction or coordinating member 260, which will be described in greater detail later, includes a lug 262 formed thereon. The lug 262 in association with the stops 256 and 258 determine the position of the pinion 240. The stops 256 and 258 are positioned approximately 180° apart from each other, except that the stop 256 is radially displaced from the axle 230 at a greater distance than is the stop 258. When the stop 256 engages with the lug 262, the pinion 240 is in the position as seen in FIGS. 7 and 11.

Figure 11:
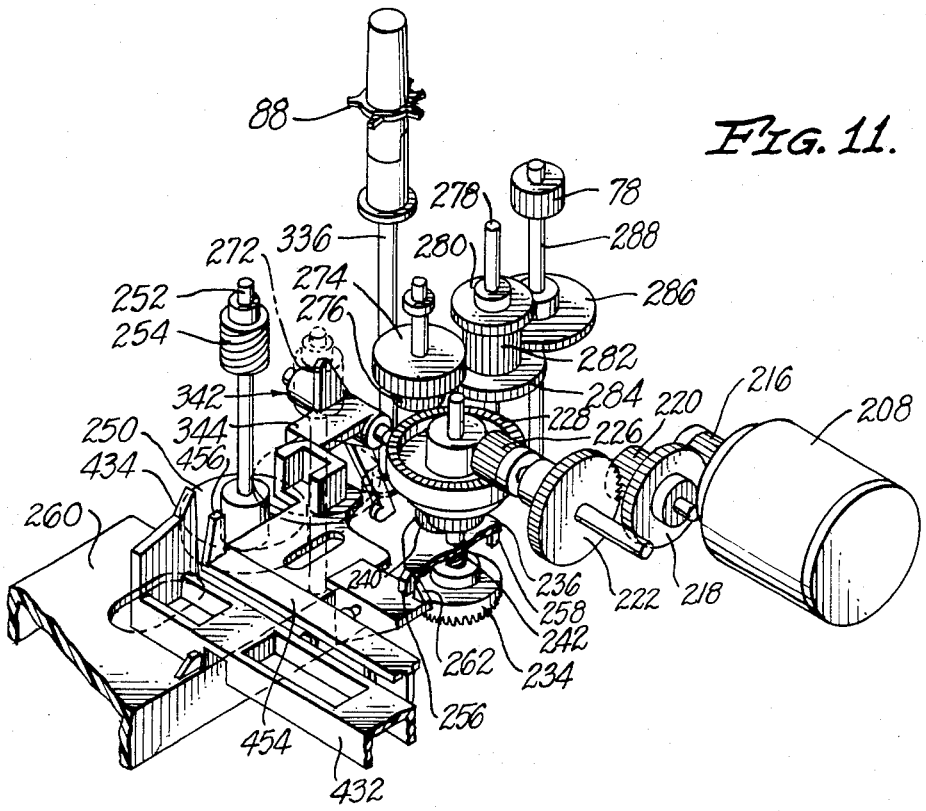
FIG. 11 is an oblique fragmentary view of certain of the components seen in the upper right hand portion of FIG. 5 with these components seen in one spatial relationship.
Figures 7, 8:
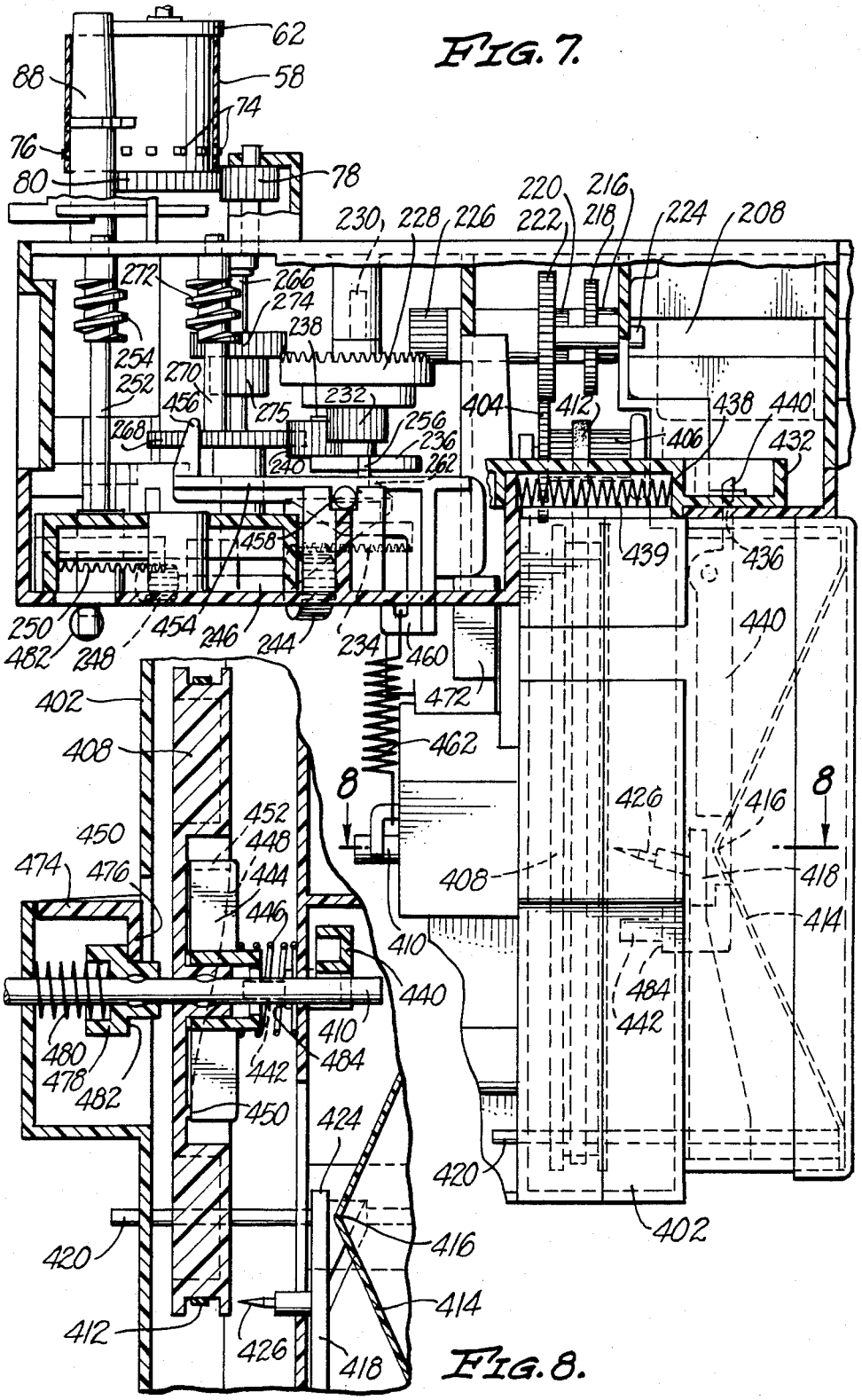
FIG. 7 is an elevational sectional view about the line 7—7 of FIG. 5 with certain overlying components removed for clarity of underlying components.
FIG. 8 is an elevational fragmentary sectional view about the line 8—8 of FIG. 7.

In the initial position as seen in FIGS. 7 and 11, the pinion 240 meshes with a spur gear 264 which is fixed to an axle 266. The spur gear 264 in turn meshes with a spur gear 268 fixedly mounted onto an axle 270. Also fixedly attached to the axle 270 is a attack connecting worm 272.

Figure 12:
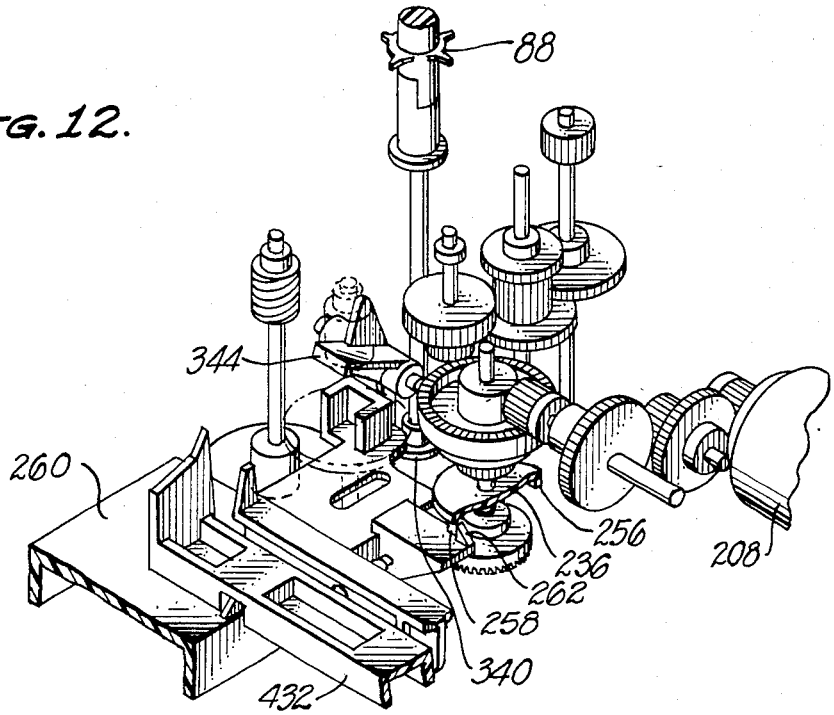
FIG. 12 is a view similar to FIG. 11 except certain of the components are seen in a different spatial relationship than as depicted in FIG. 11.

When the stop 258 is engaged against the lug 262, the pinion 240 moves to the position seen in FIG. 12, wherein it no longer engages the spur gear 264. When the pinion 240 is in the position shown in FIG. 11 wherein it engages the spur gear 264, rotation is transferred ultimately to the attack connecting worm 272. When the pinion 240 is in the position as seen in FIG. 12, no rotation is transferred to spur gear 264 and as such, no rotation is propagated to the attack connecting worm 272. The movement of the pinion 240 from the position seen between FIGS. 11 and 12 is dependent upon sliding movement of the interacting member 260 as hereinafter explained, which moves the lug 262 located on it radially toward and away from the axle 230, which positions it in two positions such that when the lug 262 is at its maximum position radially from the axle 230, rotation imparted to the disk 236 via the spring 242 engages the stop 256 against the lug 262 and when the interaction member 260 moves in a direction radially displacing the lug 262 closer to the axle 230, the lug 262 is positioned such that rotation imparted to the disk 236 by the spring 242 engages the stop 258 against the lug 262.

Aside from transmitting motion to the attack connecting worm 272, rotation of the spur gear 264 by the pinion 240 ultimately transfers rotation to the spool 62 to move the endless belt 58. As noted previously, the endless belt 58 moves either at a fast or slow speed, as is governed by the pro/am button 42. The spur gear 264 is rotated at a constant speed as is the axle 266 on which it is attached via the previously described gear train leading to the motor output pinion 216.

The endless element 58 is driven at two speeds as follows. The axle 266 carries a large and small pinion 274 and 276, respectively, in a position above the spur gear 264. Both of the pinions 274 and 276 are fixed to the axle 266 and rotate in conjunction with rotation of the axle 266. An axle 278 which is appropriately mounted within the internal middle housing 110 such that it can move upwardly and downwardly a limited amount, carries near its upper end a small spur gear 280, a pinion 282 and a large spur gear 284, all fixedly attached to and therefore capable of rotating in conjunction with, the axle 278. When the axle 278 is depressed, as hereinafter explained, the small spur gear 280 located thereon meshes with and is rotated by large pinion 274 mounted on axle 266. When the axle 278 is elevated, the large spur gear 284 mounted thereon meshes with and is rotated by the small pinion 276 attaching to axle 266. The axle 278 can be in one or the other of the depressed or elevated positions. Thus, either a connection is made between axle 266 and axle 278 via gears 274 and 280 or via gears 276 and 284.

Figure 6:
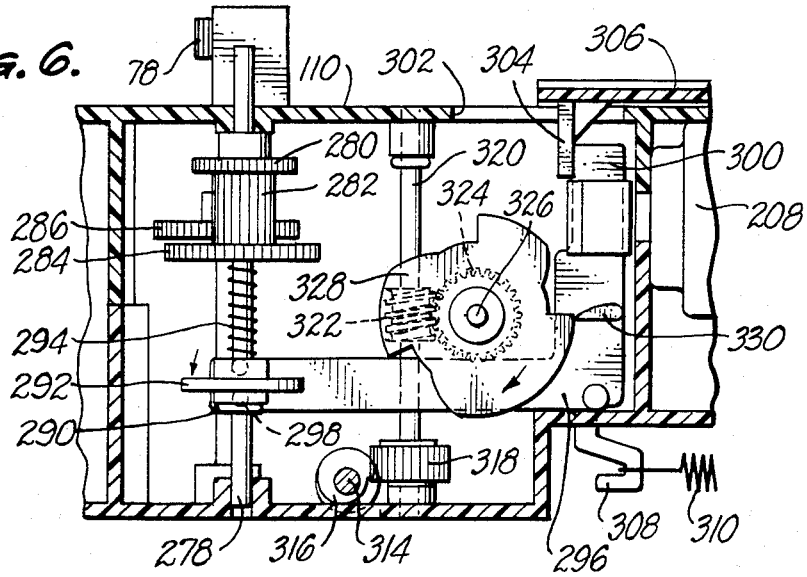
FIG. 6 is an elevational fragmentary sectional view about the line 6—6 of FIG. 5.

When the axle 278 is in the elevated position, as seen in both FIGS. 4 and 6, the connection formed between axle 266 and 278 via the gears 276 and 284 located on these respective axles results in a slow output speed of axle 278 with respect to axle 266. When axle 278 is in the depressed position axle 266 is connected to axle 278 via gears 274 and 280 resulting in a fast output speed of axle 278.

Irrespective of the elevational position of the axle 278, the pinion 282 carried thereon is always in engagement with a spur gear 286 carried on an axle 288 located adjacent to the axle 278. The spur gear 286 is fixed to the axle 288 as is pinion 78 previously described. It will be remembered that pinion 78 engages the spur gear 80 formed as a part of the spool 62. Rotation is thus transferred to the spool 62 via the axle 288. The speed of rotation transferred via the pinion 78 on the axle 288 of course depends upon the position of the axle 278.

The axle 278 is maintained in the elevated or slow output position when the pro/am button 42 is in the amateur or low skill position. The axle 278 is allowed to oscillate back and forth between the elevated or depressed position when the pro/am button 42 is in the pro or high skill level. When in the pro or higher skill level, the oscillation up and down of the axle 278 provides for a variable speed output of the endless element 58 and the complexities to the game 30 discussed above. Movement of the axle 278 from its elevated and depressed position is accomplished as follows.

The axle 278 has a bushing 290 fixedly located thereon. A disk 292 is biased against the bushing by a spring 294 which is positioned around the axle 278 between the disk 292 and the bottom of the large spur gear 284. A bell crank 296 has a yoke 298 on the end of one of its arms. The yoke 298 fits around the disk 292 such that movement of the bell crank 296 about its pivot point is transferred to the disk 292.

The yoke 298 is located on the end of the horizontal arm of the bell crank 296 with the end 300 of the vertical arm of the bell crank 296 being positioned near the uppermost portion of the internal middle housing 110. An opening 302 in this housing allows for placement of a downward projecting extension 304 of a level slide member 306 to contact the end 300 of the vertical arm of the bell crank 296.

The pro/am button 42 connects to the level slide member 306 and the level slide member 306 is slid on the internal middle housing 110 in response to the sliding of the pro/am button 42.

On the bottom of the bell crank 296 is a small tab 308 which projects out of the bottom of the internal middle housing 110 and has a spring 310 connected between it and the internal middle housing 110. The spring 310 biases the bell crank 296 such that it wants to rotate counterclockwise, as seen in FIG. 6. The extension 304 on the slide level member 306 however, holds the bell crank 296 in the position seen in FIG. 6 when the pro/am button 42 is in the amateur or low skill level. Through the interaction of the yoke 298 on the bell crank 296 forcing the disk 292 upwardly, this maintains the axle 278 in its elevated, or slow output, position such that the pinion 78 ultimately drives the endless belt at the slower of its two speeds. When the pro/am button 42 is pushed to the pro or higher skill level, the level slide member 306 moves from right to left in FIG. 6, withdrawing the extension 304 from against the end 300 of the vertical arm of the bell crank 296, allowing the spring 310 to rotate the bell crank 296 counterclockwise, which in turn depresses the axle 278 by the interaction of the yoke 298 on the disk 292. This shifts the axle 278 to its depressed, or fast output position, ultimately rotating the pinion 78 at its faster speed.

When the pro/am button button 42 is in the pro or higher skill level position, the axle 278 is continuously shifted up and down via the following mechanism. A pinion 312 is rotated by the crown gear 234 in response to output of the motor 208 driving the axle 230 as discussed above. The pinion 312 is fixedly mounted to an axle 314 which carries a worm 316 also fixedly attached to it. The worm 316 drives a pinion 318 mounted to an axle 320. The axle 320 is located at right angles to the axle 314 and includes a worm 322 fixedly attached to it. The worm 322 meshes with a pinion 324 fixedly attached to an axle 326 which lies at right angles to the axle 320.

A cam 328 is also fixedly mounted to the axle 326. The cam 328 therefore is ultimately rotated via the above described gear train leading to the crown gear 234. The cam 328 has three lobes (not separately identified or numbered) of unequal size and spacing separated by three recessed areas (not separately numbered or identified). The lobes and the spaces in the cam 328 are positioned to contact a lug 330 formed on the vertical arm of the bell crank 296. When one of the lobes contacts the lug 330, the bell crank 296 is rotated clockwise in FIG. 6 such that the axle 278 is elevated or positioned in the slow output position. When the lobe clears the lug 330, the bell crank 296 can rotate counterclockwise as seen in FIG. 6 positioning the lug 330 in one of the spaces between two adjacent lobes, which allows for shifting of the axle 278 downwardly to the depressed or fast output position. Therefore, as the cam 328 rotates, the bell crank 296 is continuously moved, shifting the axle 278 between its elevated and depressed position, therefore shifting the output of the pinion 78 from a fast to a slow output.

When the pro/am button 42 is in the amateur or low skill mode, the extension 304 of the level slide member 306 holds the bell crank 296 fast in its counterclockwise position seen in FIG. 6 such that even when the cam 328 is located such that a space between two of the adjacent lobes on it is positioned next to the lug 330, the bell crank 296 cannot rotate counterclockwise as seen in FIG. 6 to shift the axle 278.

The level slide member 306 includes a spring arm 332 which rides over a wedge 334 formed on the internal middle housing 110. Interaction of the spring arm 332 with the wedge 334 prevents the bias of the spring 310 attaching to the bell crank 296 from interacting with extension 304 to inadvertently slide the level slide member 306 to the pro or higher skill level position when the pro/am button 42 is in the amateur or low skill level position.

Figure 5:
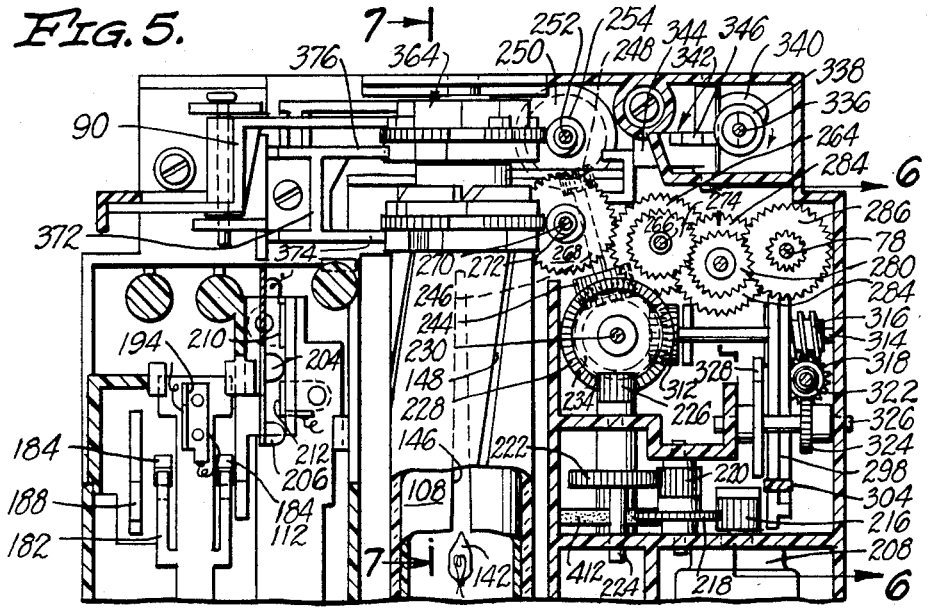
FIG. 5 is a top plan sectional view taken about the line 5—5 of FIG. 4 with certain overlying components removed for clarity of underlying components.

Referring now to FIGS. 5, 9, 11 and 12, the target system coordination mechanism is shown. The previously described endless belt output gear 88 is fixedly mounted to a shaft 336. The shaft 336 communicates from the upper internal housing 66 wherein the endless belt output gear 88 is located into the internal middle housing 110. Fixedly located on the bottom of shaft 336 is a cam 338. Since the cam rotates in response to the shaft 336 which in turn rotates in response to the gear 88, whenever any of the sets of holes such as sets of holes 82,84, or 86 pass the gear 88 with the gear 88 then engaging this set of holes, at this point in time the cam 338 is rotated. When the gear 88 is not engaged with any of the above noted sets of holes, the cam 338 is located as seen in FIG. 9, with the cam lobe 340 located thereon displaced to the left. This is also seen in FIG. 5.

A target inhibiting member 342 is positioned within the internal middle housing 110 adjacent to the cam 338 such that the cam lobe 340 can contact the same. The target inhibiting member 342 is formed as a "T" shaped member having a short leg 344 which is essentially horizontally oriented, and a longer cross piece 346 which is essentially vertically oriented, with the lower end of the cross piece 346 extending out of the bottom of the internal middle housing 110. A small spring 348 contacts the bottom of the cross piece 346 to bias this bottom member from right to left as seen in FIG. 9, which in turn biases the end of short leg 344 downwardly. The top of the cross piece 346 abutts against an internal baffle 350 formed as a part of the internal middle housing 110 to limit the downward movement of the leg 344. When the cam 338 rotates, the cam lobe 340 contacts the lower portion of the cross piece 346 of the member 342 to push this lower portion against the bias of the spring 348 holding it in its left hand position, rotating the target inhibiting member 342 about the axle 352 which holds it in position. When the cam lobe 340 has moved 180° from the position seen in FIG. 9, this has caused the member 342 to rotate counterclockwise about the axle 352 such that the short leg 344 is lifted upwardly. When the short leg 344 is in its clockwise, or horizontal, position, as is seen in FIGS. 9 and 11, the target inhibiting member 342 is in what is described as a target inhibiting position. When the member 342 is rotated counterclockwise as seen in FIG. 9, lifting the end of the leg 344 upwardly as is shown in FIG. 12, the target inhibiting member 342 would be in the target non-inhibiting position. These inhibiting and non-inhibiting positions are in respect to movement of the interaction member 260.

As will be shown below, depending upon the position of at least one other element, the interaction member 260 is biased to slide from the position as shown in FIG. 11 to the position as shown in FIG. 12. If the target inhibiting member 342 is in its inhibiting position as seen in FIG. 11, the short leg 344 located thereon is lodged against the interaction member 260, preventing the interaction member 260 from sliding diagonally from the lower left hand corner to the upper right hand corner as seen in FIG. 11. If, however, the target inhibiting member 342 is raised as is seen in FIG. 12, it is no longer in position to inhibit the sliding movement of the interaction member 260 and interaction member 260 can slide in a diagonal manner from the lower left hand to the upper right hand portion of FIGS. 11 and 12 to position this member 260 in the position shown in FIG. 12.

As previously noted, one of the consequences of the movement of the interaction member 260 is shifting of the lug 262 located thereon with respect to the stops 256 and 258 located on the disk 236.

Whenever the flat surface of the endless belt output gear 88 is against the inside surface of the endless belt 58, the cam lobe 340 on the cam 338 is oriented away from the target inhibiting member 342 with the target inhibiting member 342 being in its inhibiting position preventing movement of the interacting member 260. When the endless belt output gear 88 is allowed to rotate by engagement of the teeth located thereon with one of the sets of holes, such as sets 82, 84 or 86 located on the endless belt 58, this rotation is transferred to the cam 338 and to the lobe 340 thereon, which in turn moves the target inhibiting member 342 from its inhibiting to its non-inhibiting position, allowing the interacting member 260 to slide to the position as is shown in FIG. 12 if the interaction member 260 is not otherwise prevented from sliding as discussed below. When the gear 88 has been fully rotated through approximately one half turn such that its teeth disengage from one of the sets of holes 82, 84 or 86 or other unlabelled sets, the cam lobe 340 has disengaged from the member 342 allowing the spring 348 to once again rotate the member 342 to its inhibiting position, preventing sliding of the interaction member 260, regardless of whether or not other components, as hereinafter described, are allowing or preventing the sliding of the interaction member 260.

Referring now to FIGS. 4, 5 and 13 through 17, the attack, reset and hit activator systems will be discussed. As is evident from viewing FIG. 14, the first cylindrical member 108 is attached to the internal middle housing 110 via an extension 354 on one of its ends, the end wherein collar 114 is located. Near the other end there is a shoulder followed by a reduced diameter section 356 which terminates into an even further reduced section 358 which fits into an appropriate opening in the internal middle housing 110 to support the other end of the member 108. The second cylindrical member 112 likewise has a shoulder in it, with a reduced diameter section 360 formed to the left of that shoulder as seen in FIG. 14. An attack coordinating member 362 is fixedly mounted to the reduced section 360 of the second cylindrical member 112. A reset member 364 is rotatably mounted about the reduced diameter section 356 of the first cylindrical member 108 in between the wall of the internal middle housing 110 and the very end of the reduced section 360 of the second cylindrical member 112. The reset member 364 is free to rotate on the first cylindrical member 108 independent of rotation of the second cylindrical member 112 and the attached coordination member 362 attached thereto.

Figure 15:
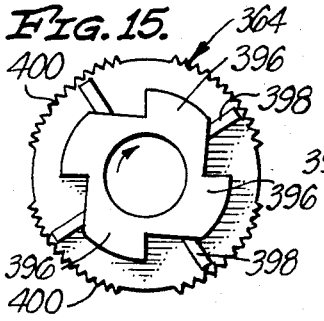
FIG. 15 is an elevational view of one of the components pictured on the left hand side of FIG. 13.
Figure 16:
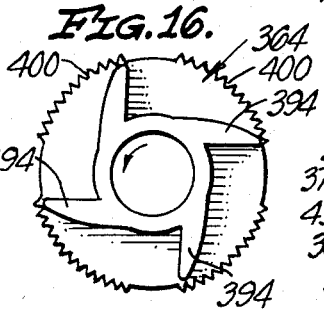
FIG. 16 is an elevational view of the other side of the components seen in FIG. 15.
Figure 17:
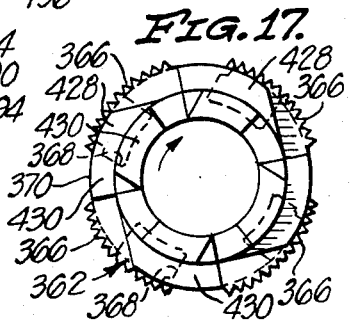
FIG. 17 is an elevational view of a component seen in the upper right hand side of FIG. 13 with certain structures of this component on its reverse side shown in phantom line.

With particular reference to FIGS. 15 through 17, it can be seen that both the reset member 364 seen in FIGS. 15 and 16 and the attack coordination member 362 seen in FIG. 17 have a four fold symmetry, as do the projections 116 and engagement steps 122 on the collar 114 of the second cylindrical member 112, and the slots 148 in the second cylindrical member 112. For each depression of the fire button 40, as noted above, the second cylindrical member 112 rotates through 90°. This, of course, also rotates the attack coordination member 362 through 90°. For every successful "hit" of one of the target images 52 with the attack image, the reset member 364 would be rotated through 90°. Both the attack coordination member 362 and reset member 364 can therefore be said to include four individual repeating elements based on this symmetry.

Each of the elements of the attack coordination member 362 includes a gear sector, collectively identified by the numeral 366. Prior to depression of the fire button 40, the attack coordination member 362 is in the position seen in FIG. 4. Upon depression of the fire button 40, as was noted earlier, the collar 114 is incrementally rotated, which in turn incrementally rotates the second cylindrical member 112 on which it is attached. This incremental rotation of the second cylindrical member 112 rotates the second cylindrical member 112 and the attack coordination member 362 attached thereto counterclockwise as seen in FIG. 4. As this happens, one of the gear sectors 366 on the attack coordination member 362 engage the attack connecting worm 372. This intermeshes the gear sector 366 with the attack connecting worm 272 such that the attack coordination member 362 and the second cylindrical member 112 to which it is attached, can be further rotated by rotation of the worm 272.

Prior to depression of the fire button 40, the interaction member 260 is in a first position locating the lug 262 on it in position to engage the stop 256 on the disk 236. Further, the target inhibiting member 342 can be in either its inhibiting or its non-inhibiting position. The interacting member 260 can move from this first position in a direction which is perpendicular to the cylindrical axis of cylindrical members 108 and 112 (which is the axis of rotation of the second cylindrical member 112) to a second position which moves the lug 262 to enage the stop 258 on the disk 236. However, it can only move from this first position to the second position if the attack inhibiting member 342 is in its non-inhibiting position as seen in FIG. 12, because a portion of the interaction member 260 must move underneath the short leg 344 of the target inhibiting member 342 in order to move into this second position.

Figure 13:
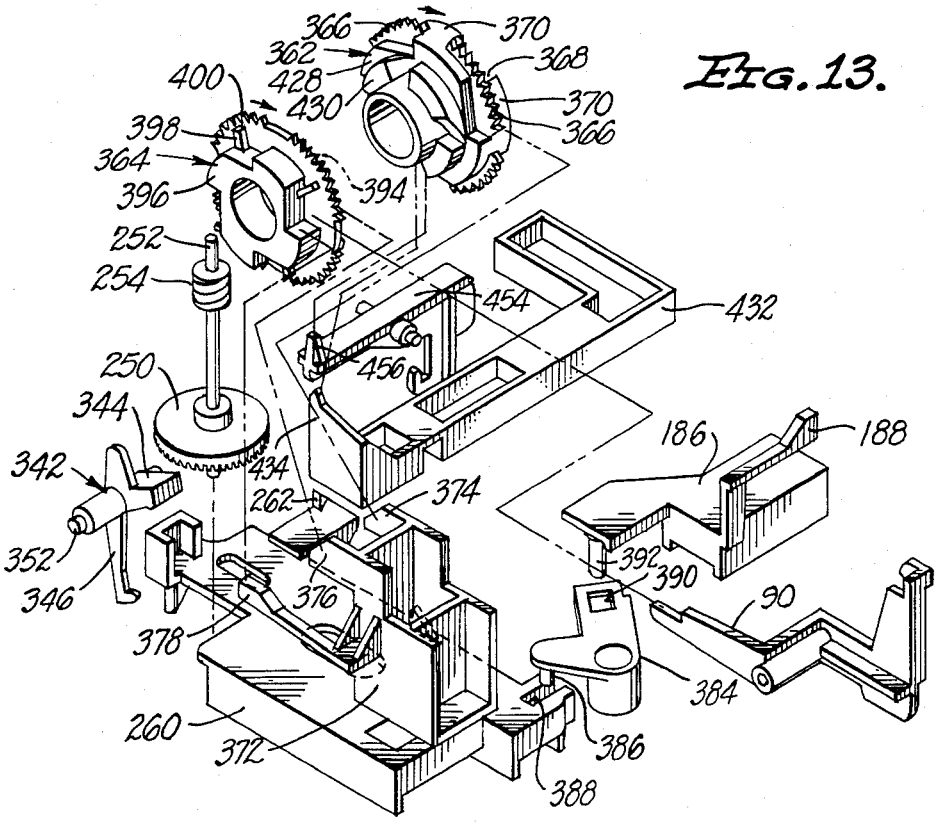
FIG. 13 is an exploded oblique fragmentary view of certain of the components seen in FIG. 5 and additional components which are hidden from view in FIG. 5.

On the area of the attack coordination member 362 on the side of the gear sectors 366 toward the end 354, there are four openings collectively identified by the numeral 368 and four surfaces collectively identified by the numeral 370. As with the sectors 366, the four openings and four surfaces 368 and 370, represent the fourfold symmetry. On the end of the interacting member 260 opposite the end wherein the lug 262 is positioned, is a coordinating fork 372. The right fork 374 as seen in FIG. 13 is positioned to interact with the attack coordinating member 362 while the left fork 376 is positiond to interact with the reset member 364. Additionally, a switching fork 378 located to the left and below the left fork 376 also interacts with the reset member 364.

A tab 380 is located on the bottom of the interaction member 260 below the coordinating fork 372. A spring 382 extends between the tab 380 and the bottom of the internal middle housing 110 to bias the interaction member 260 from its first position toward its second position. In FIGS. 4 and 5 it can be seen that the coordinating fork 372 of the interaction member 260 is in this first position. The interaction member 260 can only shift to the right in FIGS. 4 and 5 to its second position if one of the openings 368 is located in association with the tip of the right fork 374. Otherwise, the tip of the right fork 374 is held against one of the surfaces 370 preventing the interaction member 260 from shifting under the bias of this spring 282 from its first to its second position.

When the interaction member 260 is in its first position its lug 262 interacts with the stop 256 on the disk 236 positioning the pinion 240 on the disk 236 in engagement with spur gear 264 ultimately rotating the worm 272. Upon depression of the fire button 40, one of the gear sectors 366 on the attack coordination member 362 is engaged with the worm 270 and this thus rotates the attack coordination member 362 and the second cylindrical member 112 to which it is attached. As the attack coordination member 362 rotates, the tip of the right fork 374 slides along one of the surfaces 370 and eventually is positioned such that it can slide into one of the openings 368. If the interaction member 260 is prevented from sliding from its first position to its second position by the target inhibiting member 342 being in its inhibiting position, the tip of the right fork 374 will be held stationary and even though one of the openings 368 becomes located adjacent to the tip of the right fork 374, the interaction member 260 cannot shift. The attack coordination member 362 is continued to be rotated by the worm 272 to reposition the next in line surface 370 in alignment with the right fork 374 such that irrespective of the position of the target inhibiting member 342 in its inhibiting or non-inhibiting position, the interaction member 260 cannot slide from its first position to its second position because the right fork 374 now contacts the next in line surface 370, preventing it from moving from left to right as seen in FIGS. 4 and 5.

Whenever one of the surfaces 370 is in line with the right fork 374, the attack coordination member 362 can be said to be in a non-interaction position, and whenever one of the openings 368 is in line with the right fork 374, the attack coordination member 362 can be said to be in an interaction position. As the attack coordination member 362 moves from its non-interaction position to its interaction position, movement of the interaction member 260 is governed by whether or not the target inhibiting member 342 is in its inhibiting or non-inhibiting position. When the attack coordination member 362 is in its interaction position and the target inhibiting member 342 is in its inhibiting position, the attack coordination member 362 will continue to be rotated by the worm 272 until it is once again in its non-interacting position and when the totality of the particular gear sector 366 which is enmeshed with the worm 272 has been rotated by the worm 272 until these two are no longer enmeshed, rotation of the attack coordination member 362 will cease, which concurrently stops the rotation of the second cylindrical member 112. Of course, as previously explained, the rotation of the second cylindrical member 112 will register a fire on the fire counter 46.

If one of the gear sectors 366 of the attack coordination member 362 have been engaged with the worm 272 and the attack coordination member 362 is being rotated by the worm 272, positioning one of the openings 368 in line with the right fork 374 at the same time that the target inhibiting member 342 is in its non-inhibiting position, the interaction member 260 can slide from its first to its second position under the bias of the spring 382. When this happens, the tip of the right fork 374 slides into the opening 368 on the attack coordination member 362 with which it is aligned and the other end of the interaction member 260 slides underneath the short leg 344 of the target inhibiting member 342. When this happens several events occur.

With the movement of the interaction member 260 from its first to its second position, the lug 262 located on it repositions itself with respect to the stop 256, allowing the disk 236 to rotate, breaking the gear train between pinion 240 and the spur gear 264. This ceases rotation of the worm 272 which in turn ceases rotation of the attack coordination member 362. Also, upon the stopping of the rotation of the spur gear 264 the gear train to the pinion 78 is stopped and the movement of the endless belt 58 ceases, with the endless belt 58 being held in a fixed position with the target indicia 64 which is now located in the hit position being held stationary at that position.

A bell crank 384 is located adjacent to the interaction member 260 such that a boss 386 on the bell crank 384 can fit into a slot 388 on the interaction member 260. The bell crank 384 is pivotally mounted on the internal middle housing 110 and the other arm of the bell crank 384 includes a slot 390. A boss 392 formed on the hit slide member 186 fits into the slot 390. When the interaction member 260 moves from its first to its second position, the movement of the interaction member rotates the bell crank 384 which in turn slides the hit slide member 186 such that a "hit" can be registered on the hit counter 44.

The reset member 364 has four return cams collectively identified by the numeral 394 on one side of it. The return cams 394 are positioned such that they can contact and interact with the left fork 376 of the coordinating fork 372 portion of the interaction member 260. On the other side of the reset member 364 there are four switching cams collectively identified by the numeral 396 as well as four indicator cams collectively identified by the numeral 398.

When the interaction member 260 slides from its first position to its second position, the switching fork 378 on the coordinating fork 372 portion of the interaction member 260 engages one of the switching cams 396. This incrementally rotates the reset member 364. The reset member 364 also includes four gear sectors 400 located on it. Upon incremental rotation of the reset member 364 by the switching fork 378, one of the gear sectors 400 engages the reset connecting worm 254 which, as previously explained is continuously rotated by the gear train located between the output pinion 216 and it. Upon engagement of the gear sector 400 with the reset connecting worm 254, the reset member 364 is rotated on the section 356 of the member 108. It will be remembered however, that the rotation of the reset member 364 is independent of the rotation of the attack coordination member 362.

Rotation of the reset member 364 engages one of the return cams 394 against the left fork 376 of the interaction member 260. The engagement of the return cam 394 with the left fork 376 depresses the left fork 376 to the left as would be viewable in FIGS. 4 and 5, or downward and to the right as in FIG. 13. This moves the interaction member 260 from its second position back toward its first position.

Meanwhile, as this happens, one of the indicator cams 398 engages the end of lever 90, depressing this end downwardly such that the lever 90 rotates clockwise as seen in FIG. 4 to slide the plate 94, initiating the visual "hit" indication previously discussed, displayed by the plate 94.

When the interaction member 260 has moved back from its second position to its first position, its lug 262 now disengages with the stop 258, allowing for rotation of the disk 236 until the stop 256 is engaged against the lug 262, which re-engages the gear train rotating the attack connecting worm 272. Upon re-engagement of this gear train the worm 272 now rotates the attack coordination member 362 concurrent with the rotation of the reset member 364. After an incremental rotation of the attack coordination member 362, the right fork 374 is moved out of alignment with the opening 368 in which it had been located and now becomes aligned over one of the surfaces 370. The reset member 364 continues rotation until the particular gear sector 400 which had been engaged with the reset connecting worm 254 is rotated off the worm 254, with the worm then becoming located in the spaces between the individual gear sectors 400. This ceases rotation of the reset member 364. Just prior to this happening, the particular indicator cam 398 which had contacted the end of the lever 90 is rotated downwardly out of connection with the lever 90, releasing the lever 90 such that the bias in the spring 102 slides the plate 94 to the left, as seen in FIG. 4, rotating the lever 90 counterclockwise. And additionally just prior to the release of the gear sector 400 from the reset connecting worm 254, the particular return cam 394 which had engaged the left fork 376 rotates beyond the end of the left fork 376, breaking their connection.

After initial rotation of the reset member 364 by the shifting fork 378 caused by contact of the shifting fork 378 with one of the shifting cams 396, the shifting cam 396 which had been engaged presses downwardly on the shifting fork 378. The shifting fork 378 is formed as a spring arm and flexes downwardly allowing this. During rotation of the reset member 364 the particular shifting cam 396 which had been engaged rotates past the end of the shfiting fork 378 releasing the shifting fork 378 such that it can spring upwardly out of engagement with the shifting cam 396 and in position ready to be engaged with the next in line shifting cam 396.

While the interaction member 260 was in its second position, along with ceasing rotation of the attack coordination member 362, the movement of the endless belt 58 was also noted as being stopped. Upon reinstatement of the pinion 240 in engagement with the spur gear 264 concurrent with a reinstatement of the attack coordination member 362, motion of the endless belt 58 is also reinstated. With reinstatement of motion of the endless belt 58 the target inhibiting member 342 now once again alternately moves between its inhibiting and non-inhibiting position as described. Once both the reset member 364 and the attack coordination member 362 have disengaged from their respective connecting worms 272 and 254, respectively, the toy 30 is now reset and the operator of the toy 30 can once again attempt to "hit" one of the moving target images 52 on the endless belt 58.

In describing the remaining system, the audio indication system, reference will be made to FIGS. 7 through 9 in the main, and in certain instances to FIGS. 4, 5, 14 and 17. An internal lower housing 402 fits underneath the internal middle housing 110 such that spur gear 404 mounted to rotate within the internal lower housing 402 engages spur gear 202 in the drive train leading from the motor output pinion 216. Intergrally formed with the spur gear 404 is an elongated pinion 406.

A disk 408 is mounted on to an axle 410. The axle 410 is appropriately mounted within internal lower housing 402 such that it can both rotate within the housing 402 and slide axially within bearing surfaces. A belt 412 passes around a portion of the outer periphery of the disk 408 and around the elongated pinion 406 such that rotation of the spur gear 404 in turn rotates the belt 412 to rotate the disk 408 and its axle 410 attached thereto.

A diaphragm 414 is mounted within the internal lower housing 402 such that it can transmit vibrations transmitted to it. The diaphragm 414 is formed of a hard plastic material which both retains its shape and serves as a sound wave propagator. The diaphragm 414 is formed as a conical element with its apex 416 located inwardly within the internal lower housing 402.

An arm 418 is pivotally mounted to an axle 420. A small hairpin spring 422 biases the arm 420 to the right as seen in FIG. 9. The arm 418 includes an arcuately shaped cross head 424 formed as an integral part thereof with the shape of the arm 418 and the cross head 422 and the position of attachment of the axle 420 such that the cross head 424 is always capable of contacting the apex 416 of the diaphragm 414. As viewed in FIG. 9, as the arm 418 pivots about the axle 420 in a counterclockwise manner, the cross head 424 slides along the apex 416 of the diaphragm 414. The arm 418 on the side opposite that which contacts the diaphragm 414 carries a pick-up needle 426.

The surface of the disk 408 is formed as a recording disk carrying appropriate grooves encoded with an audio message, as per any standard recording disk. When the pick-up needle 426 is in engagement with the surface of the disk 408 the pick-up needle 426 follows in these grooves and is vibrated in a standard manner. This vibration is transmitted through the cross head 424 to the apex 416 of the diaphragm 414 which in turn vibrates the diaphragm 414 such that a noise is emitted from the diaphragm 414 related to the particular grooved embedded on the surface of the disk 408.

For the purposes of the toy 30 the message embedded in the grooves on the disk 408 are audio messages related to utilizing of the toy 30. Two different groups of messages are encoded onto the surface face of the disk 408. The first of these is related to depression of the fire button 40. These messages are located near the outer periphery of the surface of the disk 408. Moving radially toward the center of the disk 408 the messages encoded in the grooves located therein are related to successful "hits" of the attack image on one of the target images 52. Depending upon the length of contact of the pick-up needle 426 on the surface of the disk 408 either only the messages on the outer periphery of the disk 408 will be broadcast, or both these messages and the messages radially displaced inwardly on the surface of the disk 408 will be broadcast.

As noted above, the disk 408 and the axle 410 to which it is attached can both rotate and move axially along the axis of the axle 410 within the internal lower housing 402. When the disk 408 and its axle 410 are displaced axially as seen in FIG. 8, the connection between the pick-up needle 426 and the surface of the disk 408 is broken, allowing the hairpin spring 422 to swing the arm 418 to its starting position shown in FIG. 9. When the disk 408 and its axle 410 are in the position seen in FIG. 7, the surface of the disk 408 contacts the pick-up needle 426 and as the disk 408 rotates because of the interaction of the point of the pick-up needle 426 with the grooves in the surface of the disk 408, the pick-up needle 426 moves toward the center of the disk 408 rotating the arm 418 with it against the bias of the spring 422. When the disk 408 is moved from the position seen in FIG. 7 to that seen in FIG. 8, breaking the contact between the pick-up needle 426 and the disk 408, the arm 418 resets itself under the bias induced into the spring 422.

Movement of the disk 408 between the position wherein it does not contact the pick-up needle 426 and the position wherein it does contact the pick-up needle 426 is governed by the attack coordination member 362. There are two sets of cams on the attack coordination member 362 which control this. As with the other surfaces and cams on attack coordination member 362, and the reset member 364, these cams are present in multiples of four. The first set of cams are the positioning cams 428. The second set of cams are the shifting cams 430.

Associated with the shifting cams 430 is a drum shifting member 432. Drum shifting member 432 is slidably mounted in the internal middle housing 110 such that it can slide back and forth along a pathway which is parallel to the axis of rotation of the second cylindrical member 112. The drum shifting member 432 includes a tip 434 which interacts with the positioning cams 428. On the opposite end of the shifting member 432 from the tip 434 is a slot 436. Just adjacent to the slot 436 is a wall 438 formed as a part of the shifting member 432. A spring 439 presses against the wall 438 and a portion of the internal middle housing 110 to bias the drum shifting member 432 such that the tip 434 is biased into the positioning cams 428.

A shifting lever 440 is pivotally mounted to the internal lower housing 402 in an essentially vertical position. The upper end of the shifting lever 440 fits through the slot 436 such that movement of the drum shifting member 432 is transferred to the shifting lever 440. The lower end of the shifting lever 440 includes a horizontally oriented shifting pin 442. The shifting pin 442 is positioned to interact with a shifting blade 444. The shifting blade 444 is rotatably mounted about the axle 410 and includes a lightweight compression spring 446 associated with it. The compression spring 446 is positioned in between the shifting blade 444 and a portion of the internal lower housing 402. It biases the shifting blade 444 into the disk 408.

As can be seen in FIG. 10, in the very center of the disk 408 there are two helical cams collectively identified by the numeral 448. As the drum shifting member 432 slides on the internal middle housing 110 with respect to interaction imparted to it by the shifting cam 430 and the spring 439, its movement is transmitted to the shifting lever 440 to move the shifting pin 442 into and out of engagement with the shifting blade 444. The shifting spring 446 positions the shifting blade 444 such that in the absence of any interference the shifting blade 444 rotates about the axle 410 in conjunction with rotation of the disk 408.

The two helical cams 448 taper upwardly from the surface of the disk 408 at a point 450 to their maximum height and then have a shoulder 452. If the shifting blade 444 is restrained against rotation, it will ride along the helical cams 448 moving axially as viewed in FIG. 8 away from the surface of the disk 408. As it rides along the helical cams 448 it slowly compresses the spring 446 until such a time as it reaches the shoulders 452 at which time it will drop back to the points 450 which are almost level with the surface of the disk 408. The effect of this will be evident after discussing the positioning cams and the mechanism associated therewith.

A positioning lever 454 is pivotally mounted on the internal middle housing 110 such that a lug 456 on one of its ends can interact with the positioning cams 428. The positioning lever 454 bends at a right angle to include both a horizontal segment and a vertical segment. The horizontal segment includes the lug 456 located thereon as well as axles 458 by which the lever 454 is mounted to the housing 110. The vertical arm of the lever 454 extends downwardly and culminates in a tab 460 to which is attached a spring 462. The other end of the spring 462 is attached to the internal lower housing 402 with the spring 462 pulling downwardly on the tab 406 such that the lever 454 tends to be biased in a clockwise direction as viewed in FIG. 7. This positions the lug 456 against the shifting cams 430.

A positioning member 464 is pivotally mounted to the internal lower housing 402 about boss 466 formed thereon. The member 464 includes a tab 468 to which a spring 470 is attached. The other end of the spring 470 is attached to the internal lower housing 402 such that the member 464 as viewed in FIG. 9 is biased conterclockwise. This positions one of the arms 472 in a position such that it is capable of being engaged by the vertical portion of the lever 454 as that vertical portion descends upon clockwise rotation of the lever 454 as seen in FIG. 7.

The other arm 474 of the lever 464 includes an engagement lip 476 on its end. The engagement lip projects into the internal lower housing 402 in a position to interact with a positioning bushing 478 which is fixedly mounted to the axle 410. A spring 480 is positioned around the axle 410 between the internal lower housing 402 and the positioning bushing 478. The spring 480 has a greater bias in it than the spring 446 also noted above as being positioned around the axle 410 in engagement with the shifting blade 444. The bias of the spring 480 tends to push the bushing 478 and the axle 410 to which it is attached as well as the drum 408 also attached to the axle 410 axially to the right, as seen in FIG. 8. A shoulder 482 on the bushing 478 can be engaged by the lip 476 on the positioning member 464 to prevent axial movement of the axle 410 from left to right in FIG. 8, or if the positioning member 464 is rotated clockwise as seen in FIG. 9, by being acted upon by the positioning lever 454, the lip 476 is withdrawn away from the shoulder 482 on the bushing 478 allowing the compression spring 480 to push against the bushing 478, pushing the bushing, the axle 410 and the drum 408 to the right, as seen in FIG. 8, to engage the pick-up needle 426 against the surface of the drum 408 which has recording grooves located thereon.

When the drum 408 is so engaged with the pick-up needle 426 the spring 470 attached to the member 464 maintains the lip 476 of the member 464 against the wider diameter portion of the bushing 478. If the drum 408 and the axle 410 attached thereto are moved from right to left as seen in FIG. 8, as hereinafter explained, eventually the bushing 478 will be axially displaced to the left until the lip 476 slips over the shoulder 482 to engage the lip 476 against the shoulder 482 which then will maintain the bushing 478 and the axle 410 and the drum 408 in the position as seen in FIG. 8, which is a disengagement position with respect to the disk 408 and the pick-up needle 426.

With respect to the operation of the audio system of the toy 30, the following events happen. Upon depression of the fire button 40 and incremental rotation of the second cylindrical member 112, the attack coordination member 362 engages the worm 272 as previously explained. Upon initiation of rotation of the attack coordination member 362, the lug 456 is held against the surface of one of the positioning cams 428. As the attack coordination member 362 rotates, this surface on the positioning cam 428 rotates away from the lug 456, allowing the lug 456 to move upwardly upon clockwise rotation as seen in FIG. 7 of the lever 454 under the bias of the spring 462. This brings the vertical arm of the lever 454 downwardly against the arm 472 of the positioning member 464, rotating the positioning member 464 to release the lip 476 from the shoulder 482, allowing the spring 480 to push the bushing 478, the axle 410 and the drum 408 to the right as seen in FIG. 8, which engages the drum 408 against the pick-up needle 426.

As this is happening, one of the shifting cams 430 is engaged against the tip 434 on the drum shifting member 432, holding the spring 439 under compression, such that the shifting lever 440 has been rotated counterclockwise as seen in FIG. 7, with the shifting pin 442 moved to the right in FIG. 7. The drum 408 as seen in FIG. 7 has moved to the right to contact the pick-up needle 426, allowing the needle 426 to engage in the grooves on the recording surface of the disk 408, such that the diaphragm 414 emits a noise corresponding to the message encoded in the grooves on the surface of the disk 408.

Assuming that the fire button 40 was not pushed at the proper moment so that a "hit" is scored, but in fact the attack image had missed the target image 52, an audio signal associated with depression of the fire button 40 is emitted by the diaphragm 414. However, the audio signal corresponding to the "hit" is not emitted, because upon further rotation of the attack coordination member 362, the next positioning cam 428 contacts the lug 456 on the positioning lever 454 to rotate the positioning lever 454 counterclockwise in FIG. 7, lifting the vertical arm of the positioning lever 454 upwardly away from the arm 472 of the positioning member 474.

Just incrementally after the next in line positioning cam 428 contacts the lug 456 on the positioning lever 454, the tip 434 on the drum shifting lever 432 clears the end of the positioning cam 428 with which it is in contact, allowing the bias in the shifting spring 439 to slide the drum shifting member 432 on the internal middle housing 110 such that the shifting lever 440 rotates clockwise as seen in FIG. 7 to move the shifting pin 442 to the left as seen in FIG. 7. This positions the shifting pin 442 in the path of travel of the shift blade 444.

As shifting blade 444 rotates, it contacts shifting pin 442 and upon that contact it is prevented from further rotation. Initially upon contact of the shifting blade 444 with the pin 442, the right hand edge of the blade as seen in FIG. 8 engages the small diameter portion of the pin 442.

The drum 408 however, is in continual rotation by the motion imparted to it by the belt 412. Since the blade 444 is now stationary and the drum 408 is rotating, the helical cam 448 engage against the left hand side of the blade 444 as seen in FIG. 8, causing the blade 444 to move to the right as seen in FIG. 8. This pushes the right hand edge of the blade 444 along the small diameter portion of the pin 442 until this edge meets shoulder 484 on pin 442. The shifting lever 440 is being held stationary by the bias in the spring 439 and with shifting lever 440 engaged against the shoulder 484 further rotation of the drum 408 causes the drum 408 to move axially away from the shifting blade 444 (to the left as seen in FIG. 8). This axial movement of the drum 408 away from the shifting blade 444 continues until the lip 476 on positioning member 464 rides over the shoulder 482 on the bushing 478, at which time the bushing 478 becomes locked against the lip 476. During this, the helical cams 448 have rotated with respect to the blade 444 such that the blade 444 passes over the shoulder 452 and is pushed by the spring 446 toward the points 450 on the surface of the drum 408. As the blade 444 moves towards the points 450, it slides along the small diameter portion of the pin 442 until it clears the end of the pin 442 just prior to coming to rest against the points 450 on the surface of the drum 408. Since the blade 444 has now cleared the end of the pin 442, it is no longer prevented from rotation in association with the drum 408 and again starts to rotate with respect to the drum 408 maintaining its position on the points 450 out of the pathway of the pin 442.

As the attack coordination member 362 nears the end of is quarter rotation, the next in line shifting cam 430 engages the tip 434 on the drum shifting member 432 to slide the drum shifting member 432 on the internal middle housing 110 which in turn rotates the shifting lever 440 counterclockwise as seen in FIG. 7 to withdraw the pin 442 to the right as seen in FIG. 7 ready for the next sequence of operation.

If, instead of a "miss", a "hit" is scored, the above sequence of operation is delayed because of the stopping of rotation of attack coordination member 362 upon movement of the interaction member 360 to its second position. When this happens, the above sequence of events is interrupted at a point between when the lug 456 on the positioning lever 454 has contacted the next in line positioning cam 428 but before the tip 434 on the drum shift member 432 has slipped off of the end of the shift cam 430 with which it was engaged upon initiation of the sequence by depression of the fire button 40. After the "hit" is indicated and the indicating member 260 has moved back to its first position with the attack coordination member 362 once again being rotated the sequence of events which stops the emission of a noise from the audio system is reinstated with the tip 434 of the drum shifting member 432 sliding off the end of the shifting cam 430 with which it is engaged.

During the time that the interacting member 260 is in its second position, the pick-up needle 426 is in continuous engagement with the grooves on the surface of disk 408, allowing it to spiral closer and closer to the center of the disk 408 to get into the message area of the disk which is indicative of a "hit" being scored. During a "miss" the pick-up needle 426 simply engages the portions of the grooves on the surface of the disk 408 which are near the periphery which contain a message indicating that the fire button 40 is being pressed; however, when the pick-up needle 426 is allowed to move in closer to the center of the disk 408 on continuous contact of the pick-up needle 426 with the disk 408 because of the extended length of contact of the needle 426 with the disk 408 during the hit sequence the message indicative of a hit being scored can be broadcast by the diaphragm 414.

Figure 21:
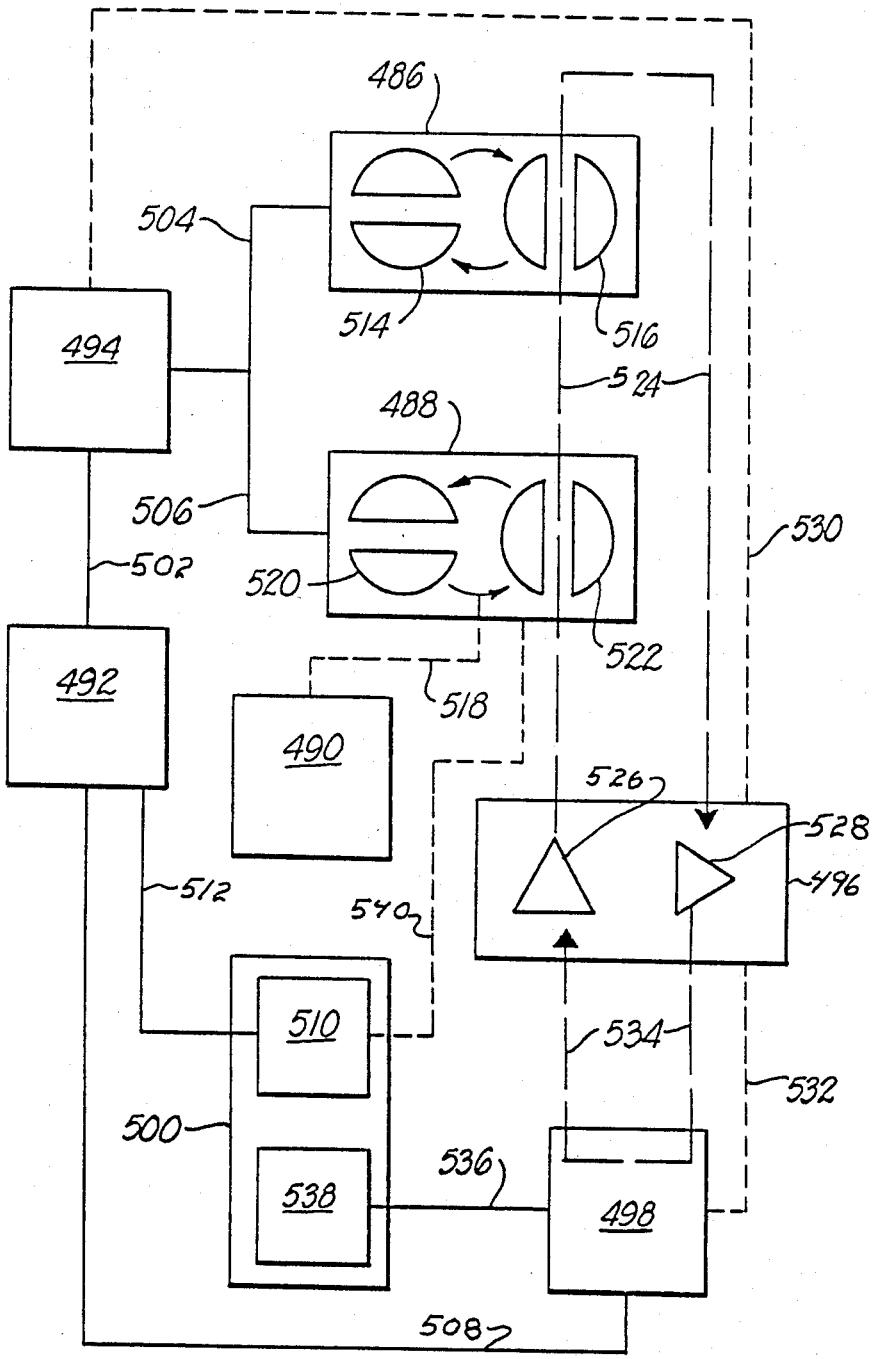
FIG. 21 is a diagrammatical representation of the operation of the embodiment of FIG. 1.

FIG. 21 shows a diagrammatical representation of the interaction of the different systems of this invention as is illustrated by the embodiment of FIG. 1. In FIG. 21, the target system is represented by the box 486, the attack system by the box 488 with the initiator system shown by the box 490. Further, the drive system is shown by the box 492 including a switching system 494 interspaced between the drive system 492 and the target and attack systems 486 and 488.

The interaction system is represented by the box 496, the reset system by the box 498 and the sensory output system by the box 500. Drive outputs, control outputs and pathways between positions represented by solid, dotted and arrowed lines, respectively, between the different systems are identified as they are introduced into the discussion. Further, certain geometrical figures located within certain of the particular boxes illustrating different component positions within the systems are also identified as discussed.

The drive system 492 feeds an output represented by the drive output line 502 to the switch system 494. The drive output is then further propagated by the switch system 494 to the target and attack systems 486 and 488 as represented by the drive output lines 504 and 506 leading to these respective systems. Further, drive output from the drive system 492 is fed to the reset system 498 as illustrated by the drive output line 508. Additionally, drive output from the drive system 492 is fed to the audio portion 510 of the sensory output system 500 as illustrated by the drive output line 512.

The target system 486 includes a portion thereof which is continuously moved back and forth between a first or inhibitory position 514 and a second or noninhibitory position 516 whenever drive output 504 is propagated to the target system 486 by the switch system 494.

In response to an initiator control output represented by the dotted line 518 outputted by the initiator system 490 to the attack system 488, a portion of the attack system 488 driven by the drive output 506 fed to the attack system 488 by the switch system 494 moves from an inhibitory or first position 520 to a non-inhibitory or second position 522 and back to the first position 520 where it stops until again activated by the initiator system 490.

When the portions of the target system 486 and the attack system 488 are in their second position 516 and 522 respectively, and only when this occurs simultaneously, will the pathway 524 be open for the interaction system 496 to move from an interaction first position represented by the triangle 526 and an initiator second position represented by the rotated triangle 528. In response thereto a control output represented by the dotted line 530 is fed back to the switch system 494 to disrupt the outputs 504 and 506 to the target system 486 and the attack system 488, temporarily holding the movable portions in their respective second positions 516 and 522. Concurrently, a control output represented by the dotted line 532 is fed to the reset system 498.

Upon receipt of the control output 532 the reset system 498 drives the interaction system 496 from its second position 528 back to its first position 526 as is represented by the pathway shown by the dotted line 534. Concurrent with this, drive output is propagated from the reset system 498 as represented by the drive output line 536 to the visual portion 538 of the sensory output system 500 with the visual portion 538 outputting a visual output in response to the drive output propagated to it.

Once the interaction system 496 returns to its first position 526 a control output is again sent via control output line 530 to the switch system 494 such that drive output from the switch system 494 via output lines 504 and 506 to the target system 486 and the attack system 488 is reinstated to initiate the continuous alternating movement of the portion of the target system 486 between the positions 514 and 516 and to return the portion of the attack system 488 from its second position 522 to its first position 520, wherein it can once again be activated by the initiator system 490 to move to its second position 522.

The movable portion of the attack system 488, when moving to its second position 522, emits a control output represented by the dotted line 540 to activate the audio portion 510 of the sensory output system 500. The audio output outputted by the audio portion 510 will be a first audio output in response to the movable portion of the attack system 488 moving from the first position 520 to the second position 522 when the movable portion of the target system 486 is in its first position 514 and a second audio output when the pathway 524 is completed by the simultaneous location of the movable portion of the attack system 488 in its second position 522 and the target system 486 in its second position 522.

We claim:

1. A toy game which comprises:

a housing;

drive means located on said housing;

target means mounted on said housing in operative association with said drive means, said target means including a target and a target coordination means, both said target and said target coordination means continuously moved on said housing by said drive means, said target moving through a target field wherein said target field includes a target hit position, said target coordination means moving between an interaction position and a non-interaction position with said target coordination means being in said interaction position when said target is in said hit position;

attack means movably mounted on said housing in association with said drive means, said attack means including an attack coordination means, said attack coordination means temporarily operatively connectible to said drive means and when so temporarily connected said drive means moving said attack coordination means;

initiator means operatively associated with said attack means, said initiator means located on said housing in a position enabling said initiator means to be acted upon by an operator of said toy and when so acted upon by said operator of said toy said initiator means operatively interacting with said attack means to temporarily operatively connect said attack coordination means with said drive means whereby said drive means moves said attack coordination means from its non-interaction position to its interaction position and then back to its non-interaction position;

interaction means slidably mounted on said housing in operative association with said target coordination means and said attack coordination means, said interaction means linearly movable on said housing between a first position and a second position, said interaction means slidable from its said first position to its said second position when both of said target coordination means and said attack coordination means are simultaneously in their respective interaction positions and said interaction means incapable of sliding from its said first position to its said second position when either one or both of said target coordination means and said attack coordination means are in their respective non-interaction position;

means associated with said interaction means for sliding said interaction means from its said first position to its said second position;

indicating means located on said housing, said indicating means capable of producing an output which is sensory perceivable by said operator of said toy, said indicating means producing said sensory perceivable output when said operator of said toy has acted upon said initiator means in association with said target being in said hit position resulting in both said target coordination means and said attack coordination means being in their interaction position thereby allowing said interaction means to move to its second position.

2. A toy game which comprises:

a housing;

drive means located on said housing;

target means mounted on said housing in operative association with said drive means, said target means including a target and a target coordination means, both said target and said target coordination means continuously moved on said housing by said drive means, said target moving through a target field wherein said target field includes a target hit position, said target coordination means moving between an interaction position and a non-interaction position with said target coordination means being in said interaction position when said target is in said hit position;

attack means movably mounted on said housing in association with said drive means, said attack means including an attack coordination means, said attack coordination means temporarily operatively connectible to said drive means and when so temporarily connected said drive means moving said attack coordination means;

initiator means operatively associated with said attack means, said initiator means located on said housing in a position enabling said initiator means to be acted upon by an operator of said toy and when so acted upon by said operator of said toy said initiator means operatively interacting with said attack means to temporarily operatively connect said attack coordination means with said drive means whereby said drive means moves said attack coordination means from its non-interaction position to its interaction position and then back to its non-interaction position;

interaction means movably mounted on said housing in operative association with said target coordination means and said attack coordination means, said interaction means movable on said housing between a first position and a second position, said interaction means movable from its said first position to its said second position when both of said target coordination means and said attack coordination means are simultaneously in their respective interaction positions and said interaction means incapable of moving from its said first position to its said second position when either one or both of said target coordination means and said attack coordination means are in their respective non-interaction position;

means associated with said interaction means for moving said interaction means from its said first position to its said second position;

indicating means located on said housing, said indicating means capable of producing an output which is sensory perceivable by said operator of said toy, said indicating means producing said sensory perceivable output when said operator of said toy has acted upon said initiator means in association with said target being in said hit position resulting in both said target coordination means and said attack coordination means being in their interaction position thereby allowing said interaction means to move to its second position;

reset means operatively associated with said interaction means, said reset means associated with said drive means and moved by said drive means in response to said interaction means having moved to its second position;

said reset means in response to being moved by said drive means capable of moving said interaction means from its second position back to its first position.

3. The toy game of claim 2 including:

first switch means, said first switch means operatively associated with said reset means and said drive means and capable of connecting said reset means to said drive means in response to movement of said interaction means from its first to its second position.

4. The toy game of claim 3 further including:

second switch means operatively associated with said attack means and connecting said attack means to said drive means;

said second switch means having an initial switching position and a subsequent switching position, said drive means capable of driving said attack means when said second switch means is in said initial switch position;

said interaction means interacting with said second switch means to switch said second switch means from said initial switching position to said subsequent switching position in response to said interaction means moving from its first position to its second position and said interaction means switching said second switch means from said subsequent switching position to said initial switching position in response to said interaction means moving from its second position to its first position.

5. The toy game of claim 4 including:

said attack means including an attack indicator means, said attack indicator means operatively associated with and moving in conjunction with said attack coordination means as said attack coordination means moves from its non-interaction position to its interaction position.

6. The toy game of claim 5 including:

interaction counting means capable of displaying a log reflecting movement of said interaction means from its first position to its second position;

initiator counting means capable of displaying a log reflecting the acts of said operator on said initiator means.

7. The toy game of claim 6 wherein:

said attack coordination means is rotatably mounted in said housing;

said reset means is rotatably mounted in said housing;

said interaction means is mounted in said housing in a position such that it can contact both of said attack coordination means and said reset means.

8. The toy game of claim 7 wherein:

said target means includes a plurality of targets each moving through said target field and independently positionable in said target hit position;

said target coordination means being located in its interaction position whenever any member of said plurality of said targets is positioned in said hit position within said field.

9. The toy game of claim 8 wherein:

said attack coordination means includes an attack coordination member;

said reset means comprises a reset member;

said attack coordination member and said reset member rotatably mounted about a common axis of rotation and axially displaced along this axis of rotation in a position locating each in association with said interaction means.

10. The toy game of claim 9 wherein said interaction means comprises an interaction member slidably mounted in association with both said attack coordination member and said reset member and movable with respect to said attack coordination member and said reset member in a direction perpendicular to their axis of rotation, said interaction member sliding longitudinally between its first position and its second position;

said target coordination means includes an inhibiting member positioned adjacent to said interaction member and movable with respect to said interaction member between an inhibiting position and a non-inhibiting position, said inhibiting member preventing said interaction member from sliding on said housing from its first position to its second position when said inhibiting member is in said inhibiting position and allowing said interaction member to slide on said housing frim its first position to its second position when said inhibiting member is in said non-inhibiting position.

11. The toy game of claim 10 wherein:

said attack coordination member includes a plurality of attack coordination elements each having a non-interaction position and an interaction position located thereon and including said interaction member being capable of interacting with each of said attack coordination elements with each individual attack coordination element when interacting with said interaction member allowing or preventing said interaction member from sliding on said housing from its said first position to its said second position;

said reset member includes a plurality of reset elements equal in number to the number of said plurality of said attack coordination elements with each of said reset elements capable of interacting with said interaction member to slidably move said interaction member on said housing from its said second position to its said first position.

12. The toy game of claim 11 wherein:

said drive means includes a motor, a gear train means, an attack connecting gear and a reset connecting gear;

said gear train means extending between said motor and both said attack connecting gear and said reset connecting gear;

said attack coordination member capable of being operatively connected to and rotated by said attack connecting gear;

said reset member capable of being operatively connected to and rotated by said reset connecting gear;

said second switch means is inter-positioned in said gear train means between said motor and said attack connecting gear;

said interaction means slides perpendicular to said axis of rotation.

13. The toy game of claim 1 wherein:

said attack means is rotatably mounted on said housing;

said initiator means interacting with said attack means to incrementally rotate said attack coordination means engaging said attack coordination means with said drive means.

14. The toy game of claim 13 wherein:

said attack coordination means including an attack coordination member, said drive means including an attack connecting gear, said drive means including at least one other element, said attack connecting gear capable of being rotated by said one other element;

said attack coordinating member having gear teeth, said attack coordinating member located with respect to said attack connecting gear such that said gear teeth are in a position capable of being associated with said attack connecting gear;

said incremental rotation of said attack coordination means by said initiator means engaging said gear teeth located on said attack coordination member with said attack connecting gear.

15. The toy game of claim 14 wherein:

said engagement of said gear teeth on said attack coordinating member with said attack connecting gear moves said attack coordination means from its non-interaction position to its interaction position and then back to its non-interaction position.

16. The toy game of claim 1 wherein:

said target means includes an endless element mounted on said housing so as to be continuously moved in a pathway on said housing by said drive means;

said target located on said endless element;

said hit position comprising a hit location in said pathway.

17. The toy game of claim 16 wherein:

said target coordination means includes an endless element output means, said endless element output means movable on said housing as said endless element moves in said pathway.

18. The toy game of claim 17 wherein:

said target coordination means further includes an inhibiting means located in association with said interaction means and operatively connected to said endless element output means, said inhibiting means moving in association with the movement of said endless element output means between an inhibiting position and a noninhibiting position;

said inhibiting means preventing said interaction means from moving from its first position to its second position when said inhibiting means is in its inhibiting position and allowing said interaction means to move from its said first position to its said second position when said inhibiting means is in its non-inhibiting position.

19. The toy game of claim 18 wherein:

said inhibiting means comprises an inhibiting member pivotally mounted on said housing and capable of pivoting between said inhibiting and said non-inhibiting positions.

20. The toy game of claim 19 wherein:

said target means further includes a target cam means interposed between said endless element output means and said inhibiting member, said target cam means moving said inhibiting member in response to movement transferred to said target cam means by said endless element output means as said endless element is moved on said housing.

21. The toy game of claim 1 wherein:

said attack means includes an attack indicator means;

said attack indicator means including a first cylindrical element, a second cylindrical element and a light emitting means, each of said first and said second cylindrical elements opaque with respect to the transmission of light from the interior of said cylindrical elements to the exterior of said cylindrical elements;

said first cylindrical element including an axially extending light transmitting slot formed in it;

said second cylindrical element including a helically extending light transmitting slot formed in it;

said light emitting means located inside of said first cylindrical element, said light emitting means capable of radiating light out of said slot formed in said first cylindrical element;

said second cylindrical element rotatably mounted co-axially with and around said first cylindrical element, said second cylindrical element operatively connected to said drive means and capable of being rotated about said first cylindrical element by said drive means;

a light emitting window being formed on said attack indicator means wherein a portion of said helical slot of said second cylindrical element overlays said axial slot of said first cylindrical element;

said drive means rotating said second cylindrical element on said first cylindrical element as said attack coordinating means moves from its non-interacting position to its interacting position and said rotation of said second cylindrical element on said first cylindrical element moving said helical slot on said second cylindrical element with respect to said axial slot on said first cylindrical element resulting in said light emitting window moving axially along said attack indicator means as said portion of said helical slot which overlays said axial slot changes along the length of said helical slot in response to rotation of said second cylindrical member with respect to said first cylindrical member.

22. The toy game of claim 21 wherein:

said target means includes a plurality of targets each moving through said target field and independently positionable in said target hit position;

said target coordination means being located in its interaction position whenever any member of said plurality of said targets is positioned in said hit position within said field.

23. The toy game of claim 1 including:

sound reproducing means located on said housing, said sound reproducing means capable of emitting a recorded sound;

said sound reproducing means operatively connected to said drive means and driven by said drive means so as to emit said recorded sound;

said sound reproducing means operatively associated with said attack means so as to be controlled by said attack means to emit said recorded sound as said attack coordination means is moved by said drive means.

24. The toy game of claim 2 wherein:

said reset means is rotatably mounted on said housing;

said interaction means operatively contacting said reset means as said interaction means moves from its first position to its second position;

said contact between said interaction means and said reset means incrementally rotating said reset means, said incremental rotation of said reset means engaging said reset means with said drive means and when so engaged said drive means moving said reset means.

25. The toy game of claim 24 wherein:

said reset means includes a reset member, said drive means including a reset connecting gear, said drive means including at least one other element, said reset connecting gear capable of being rotated by said one other element;

said reset member having gear teeth, said reset member located with respect to said reset connecting gear such that said gear teeth are in a position capable of being associated with said reset connecting gear;

said incremental rotation of said reset means by said interaction means engaging said reset member gear teeth with said reset connecting gear.

26. The toy game of claim 2 wherein:

said indicating means is operatively associated with at least one of said attack means and said interaction means.

27. The toy game of claim 26 wherein:

said indicating means is capable of producing two types of outputs and both of said types of output are sensory perceivable by the operator of said toy.

28. The toy game of claim 27 wherein:

at least one of said types of output is a visual sensory perceivable output.

29. The toy game of claim 28 wherein:

at least one of said types of said output is an auditory sensory perceivable output.

30. The toy game of claim 29 wherein:

the other of said type of output is a visual sensory perceivable output.

31. The toy game of claim 30 wherein:

said auditory sensory perceivable output is produced by sound reproducing means located on said housing, said sound reproducing means capable of emitting a recorded sound;

said sound reproducing means operatively connected to said drive means and driven by said drive means so as to emit said recorded sound;

said sound reproducing means operatively associated with said attack means so as to be controlled by said attack means to emit said recorded sound as said attack coordination means is moved by said drive means.

32. The toy game of claim 4 wherein:

said attack coordination means includes an attack coordination member;

said reset means comprises a reset member.

33. The toy game of claim 32 wherein:

said drive means includes a motor, a gear train means, an attack connecting gear and a reset connecting gear;

said gear train means extending between said motor and both said attack connecting gear and said reset connecting gear;

said attack coordination member capable of being operatively connected to and rotated by said attack connecting gear;

said reset member capable of being operatively connected to and rotated by said reset connecting gear.

34. The toy game of claim 33 wherein:

said second switch means is inter-positioned in said gear train means between said motor and said attack connecting gear.

35. The toy game of claim 14 wherein:

said attack coordination member includes a plurality of attack coordination elements each having a non-interaction position and an interaction position located thereon and including said interaction member being capable of interacting with each of said attack coordinating elements with each individual attack coordinating element when interacting with said interaction member allowing or preventing said interaction member from sliding on said housing from its said first position to its said second position.

36. The toy game of claim 35 wherein:

said reset means is rotatably mounted on said housing;

said interaction means operatively contacting said reset means as said interaction means moves from its first position to its second position;

said contact between said interaction means and said reset means incrementally rotating said reset means, said incremental rotation of said reset means engaging said reset means with said drive means and when so engaged said drive means moving said reset means.

37. The toy game of claim 36 wherein:

said reset means includes a reset member, said drive means including a reset connecting gear, said drive means including at least one other element, said reset connecting gear capable of being rotated by said one other element;

said reset member having gear teeth, said reset member located with respect to said reset connecting gear such that said gear teeth are in a position capable of being associated with said reset connecting gear;

said incremental rotation of said reset means by said interaction means engaging said reset member gear teeth with said reset connecting gear.

38. The toy game of claim 37 wherein:

said reset member includes a plurality of reset elements equal in number to the number of said plurality of said attack coordinating elements with each of said reset elements capable of interacting with said interaction member to slidably move said interaction member on said housing from its said second position to its said first position.

39. The toy game of claim 2 wherein:

said attack coordination means includes an attack coordination member;

said reset means comprises a reset member.

40. The toy game of claim 39 wherein:

said attack coordination member and said reset member rotatably mounted about a common axis of rotation and axially displaced along this axis of rotation in a position locating each in association with said interaction means;

said interaction means comprises an interaction member slidably mounted in association with both said attack coordination member and said reset member and movable with respect to said attack coordination member and said reset member in a direction perpendicular to their axis of rotation.

41. The toy game of claim 40 wherein:

said interaction means slides perpendicular to said axis of rotation.

42. The toy game of claim 1 wherein:

said attack coordination means includes an attack coordination member;

said interaction means comprises an interaction member slidably mounted on said housing;

said interaction member slides longitudinally between its first position and its second position;

said target coordination means includes an inhibiting member positioned adjacent to said interaction member and movable with respect to said interaction member between an inhibiting position and a non-inhibiting position, said inhibiting member preventing said interaction member from sliding on said housing from its first position to its second position when said inhibiting member is in said inhibiting position and allowing said interaction member to slide on said housing from its first position to its second position when said inhibiting member is in said non-inhibiting position.

43. The toy game of claim 42 wherein:

said attack coordination member includes a plurality of attack coordination elements each having a non-interaction position and an interaction position located thereon and including said interaction member being capable of interacting with each of said attack coordinating elements with each individual attack coordinating element when interacting with said interaction member allowing or preventing said interaction member from sliding on said housing from its said first position to its said second position.

44. The toy game of claim 16 wherein:

said attack means includes an attack indicator means;

said attack indicator means including a first cylindrical element, a second cylindrical element and a light emitting means, each of said first and said second cylindrical elements opaque with respect to the transmission of light from the interior of said cylindrical elements to the exterior of said cylindrical elements;

said first cylindrical element including an axially extending light transmitting slot formed in it;

said second cylindrical element including a helically extending light transmitting slot formed in it;

said light emitting means located inside of said first cylindrical element, said light emitting means capable of radiating light out of said slot formed in said first cylindrical element;

said second cylindrical element rotatably mounted co-axially with and around said first cylindrical element, said second cylindrical element operatively connected to said drive means and capable of being rotated about said first cylindrical element by said drive means;

a light emitting window being formed on said attack indicator means wherein a portion of said helical slot of said second cylindrical element overlays said axial slot of said first cylindrical element;

said drive means rotating said second cylindrical element on said first cylindrical element as said attack coordinating means moves from its non-interacting position to its interacting position and said rotation of said second cylindrical element on said first cylindrical element moving said helical slot on said second cylindrical element with respect to said axial slot on said first cylindrical element resulting in said light emitting window moving axially along said attack indicator means as said portion of said helical slot which overlays said axial slot changes along the length of said helical slot in response to rotation of said second cylindrical member with respect to said first cylindrical member.

45. The toy game of claim 44 wherein:

said target means includes a plurality of targets each moving through said target field and independently positionable in said target hit position;

said target coordination means being located in its interaction position whenever any member of said plurality of said targets is positioned in said hit position within said field.

46. The toy game of claim 25 wherein:

said attack means is rotatably mounted on said housing;

said initiator means interacting with said attack means to incrementally rotate said attack coordination means engaging said attack coordination means with said drive means;

said attack coordination means including an attack coordination member, said drive means including an attack connecting gear, said drive means including at least one other element, said attack connecting gear capable of being rotated by said one other element;

said attack coordinating member having gear teeth, said attack coordinating member located with respect to said attack connecting gear such that said gear teeth are in a position capable of being associated with said attack connecting gear;

said incremental rotation of said attack coordination means by said inhibitor means engaging said gear teeth located on said attack coordination member with said attack connecting gear.

47. A toy which comprises:

a housing;

a drive means located on said housing and capable of producing an output;

a first means located on said housing in operative association with said drive means so as to receive output from said drive means and in response to receipt of said output at least a portion of said first means movable on said housing between a first means first position and a first means second position;

a second means located in said housing in operative association with said drive means so as to receive output from said drive means and in response to receipt of said output at least a portion of said second means movable on said housing between a second means first position and a second means second position;

a third means located on said housing in operative association with both said first and said second means, said third means movable on said housing between a third means first position and a third means second position, said third means movable from said third means first position to said third means second position only when both said first means is in said first means second position and said second means is in said second means second position;

third means moving means located on said housing in operative association with said third means and capable of moving said third means from said third means first position to said third means second position;

a fourth means located on said housing in operative association with said drive means so as to receive output from said drive means and further located in mechanical association with said third means and in response to said third means moving to said third means second position said fourth means contacting said third means and returning said third means from said third means second position to said third means first position.

48. The toy of claim 47 including:

a switch means interspaced between both of said first and said second means and said drive means whereby said output from said drive means received by said first means and said second means is progagated through said switch means to said first means and said second means, said switch means further operatively associated with said third means whereby when said third means is in said third means first position output from said drive means is propagated by said switch means to said first means and said second means and when said third means is in said third means second position output from said drive means is not propagated by said switch means to said first means and said second means.

49. The toy of claim 48 further including:

a second means initiator means operatively associated with said second means and capable of being acted upon by the operator of said toy and when so acted upon by said operator of said toy said second means initiator means initiating movement of said portion of said second means from said second means first position to said second means second position;

and when said output of said drive means is propagated to said first means by said switch means said portion of said first means continuously moves alternately between said first means first position and said first means second position;

and when said output of said drive means is propagated to said second means by said switch means and said movement of said portion of said second means has been initiated by said initiator means the output propagated by said switch means to said portion of said second means moves said portion of said second means from said second means first position to said second means second position and back again to said second means first position with said portion of said second means having moved back to said first position then ceasing any further movement until said initiator means once again initiates movement of said portion of said second means from said second means first position to said second means second position.

50. The toy of claim 49 including:

sensory output means capable of moving said housing under the influence of said output of said drive means and operatively associated with both said second means and said fourth means whereas said sensory output means outputs a first sensory perceivable output upon movement of said portion of said second means between its said positions and outputs a second sensory perceivable output upon movement of said third means between its said positions.

51. The toy of claim 50 wherein:

said sensory output means is capable of outoutting a visually perceivable sensory output and an auditory perceivable output;

said visually perceivable output outputted in response to said portion of said second means moving between its said positions;

said auditory perceivable outputted in response to said third means moving between its said positions.

52. The toy of claim 48 including:

a second means initiator means operatively associated with said second means and capable of being acted upon by the operator of said toy and when so acted upon by said operator of said toy said second means initiator means initiating movement of said portion of said second means from said second means first position to said second means second position;

and when said output of said drive means is propagated to said first means by said switch means said portion of said first means continuously moves alternately between said first means first position and said first means second position;

and when said output of said drive means is propagated to said second means by said switch means and said movement of said portion of said second means has been initiated by said initiator means the output propagated by said switch means to said portion of said second means moves said portion of said second means from said second means first position to said second means second position and back again to said second means first position with said portion of said second means having moves back to said first position then ceasing any further movement until said initiator means once again initiates movement of said portion of said second means from said second means first position to said second means second position.

* * * * *

UNITED STATES PATENT AND TRADEMARK OFFICE

CERTIFICATE OF CORRECTION

PATENT NO. : 4,522,409

DATED : June 11, 1985

INVENTOR(S) : NOBUO KOBAYASHI

It is certified that error appears in the above-identified patent and that said Letters Patent is hereby corrected as shown below:

Column 1, line 68, "initiation" should read --initiator--.

Column 2, line 27, "for" should read --of--.

Column 2, lines 41 and 42 between the words "first" on line 41 and "means" on line 42 add the word --switch--

Column 2, line 56 after the word "interaction" add the word --means--.

Column 2, line 60 "Preferred" should be --Preferably--.

Column 3, line 12 "preferred" should be --preferably--.

Column 4, Line 41 "broke" should be --broken--.

Column 7, line 33 "bervity" should be --brevity--.

Column 8, line 11 "78" should be --58--.

Column 8, line 53 after the number "30" delete the word --of--.

Column 9 line 23 "changes" should be--change--.

Column 11, line 45 "40" should be --142--.

Column 13, line 56 "184" should be --194--.

Column 14, line 40 "140" should be --40--.

Column 15, line 45 "42" should be --242--.

UNITED STATES PATENT AND TRADEMARK OFFICE

CERTIFICATE OF CORRECTION

PATENT NO. : 4,522,409

DATED : June 11, 1985

INVENTOR(S) : NOBUO KOBAYASHI

It is certified that error appears in the above-identified patent and that said Letters Patent is hereby corrected as shown below:

Column 18, line 1 after the word "button" delete the second occurrence of the word --button--.

Column 21, line 15 "enage" should be --engage--.

Column 21, line 32 "positiond" should be --positioned--.

Column 24, line 41 "intergrally" should be --integrally--.

Column 24, line 59 "420" should be --418--.

Column 24, line 62 "422" should be --424--.

Column 25, line 13 "grooved" should be --grooves--.

Column 28, line 36 "engage" should be --engages--.

Column 30, line 21 "initiator" should be --interaction--.

Column 34, line 12 "frim" should be --from--.

Column 42, line 7 "outoutting" should be --outputting--.

Column 42, line 37 "moves" should be --moved--.

Signed and Sealed this

*Fourteenth* Day of *January 1986*

[SEAL]

*Attest:*

*Attesting Officer*

DONALD J. QUIGG

*Commissioner of Patents and Trademarks*